US008624473B2

(12) United States Patent
Nakayama et al.

(10) Patent No.: US 8,624,473 B2
(45) Date of Patent: Jan. 7, 2014

(54) SPARK PLUG

(75) Inventors: Katsutoshi Nakayama, Aichi (JP); Nobuaki Sakayanagi, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 234 days.

(21) Appl. No.: 13/138,779

(22) PCT Filed: Mar. 25, 2010

(86) PCT No.: PCT/JP2010/002095
§ 371 (c)(1),
(2), (4) Date: Sep. 27, 2011

(87) PCT Pub. No.: WO2010/113433
PCT Pub. Date: Oct. 7, 2010

(65) Prior Publication Data

US 2012/0019120 A1 Jan. 26, 2012

(30) Foreign Application Priority Data

Mar. 31, 2009 (JP) ..... 2009-084687

(51) Int. Cl.
*H01T 13/20* (2006.01)

(52) U.S. Cl.
USPC ..... 313/141

(58) Field of Classification Search
None
See application file for complete search history.

(56) References Cited

U.S. PATENT DOCUMENTS

| | | | | |
|---|---|---|---|---|
| 4,700,103 | A | 10/1987 | Yamaguchi et al. | 313/141 |
| 6,215,235 | B1 | 4/2001 | Osamura | 313/141 |
| 6,307,307 | B1 | 10/2001 | Kanao | 313/142 |
| 6,337,533 | B1 | 1/2002 | Hanashi et al. | 313/141 |
| 6,373,172 | B1 | 4/2002 | Kanao et al. | 313/141 |
| 6,642,638 | B2 | 11/2003 | Ishiguro | 313/141 |
| 2002/0021066 | A1 | 2/2002 | Kanao | 313/141 |
| 2002/0105254 | A1 | 8/2002 | Hori et al. | 313/141 |
| 2005/0176332 | A1 | 8/2005 | Juestel et al. | 445/7 |
| 2007/0103046 | A1 | 5/2007 | Tinwell | 313/143 |

FOREIGN PATENT DOCUMENTS

| | | | |
|---|---|---|---|
| EP | 0 936 710 A1 | 8/1999 | |
| JP | 61-45583 | 3/1986 | H01T 13/20 |
| JP | 11-354251 | 12/1999 | H01T 13/32 |
| JP | 2001-210447 | 8/2001 | H01T 13/20 |
| JP | 2002-83662 | 3/2002 | H01T 13/20 |
| JP | 2004-517459 | 6/2004 | H01T 21/02 |
| JP | 2007-087969 | 4/2007 | H01T 13/20 |
| JP | 2007-328967 | 12/2007 | H01T 13/20 |
| JP | 4092889 | 5/2008 | H01T 13/16 |

OTHER PUBLICATIONS

International Search Report for International Application No. PCT/JP2010/002095 dated Jul. 20, 2010; 2 pages.
European Search Report (from corresponding European Patent App. No. 10758218, dated Oct. 23, 2013—7 pages.

*Primary Examiner* — Britt D Hanley
(74) *Attorney, Agent, or Firm* — Kusner & Jaffe

(57) ABSTRACT

A method for improving welding strength between a ground electrode and a noble metal tip on a spark plug. A fusion zone is formed along at least a portion of the boundary between the ground electrode and the noble metal tip through fusion of a portion of the ground electrode and a portion of the noble metal tip.

21 Claims, 15 Drawing Sheets

FIG. 1

3: CERAMIC RESISTOR
4: SEAL BODY
5: GASKET
6: RING MEMBER
7: RING MEMBER
8: SHEET PACKING
9: TALC
10: CERAMIC INSULATOR
12: AXIAL HOLE
13: LEG PORTION
15: STEPPED PORTION
17: FRONT TRUNK PORTION
18: REAR TRUNK PORTION
19: FLANGE PORTION
20: CENTER ELECTRODE
22: FRONT END PORTION
25: CORE
30: GROUND ELECTRODE
40: METAL TERMINAL
50: METALLIC SHELL
51: TOOL ENGAGEMENT PORTION
52: MOUNTING THREADED PORTION
53: CRIMP PORTION
54: SEAL PORTION
55: SEAT SURFACE
56: STEPPED PORTION
58: BUCKLE PORTION
59: SCREW NECK
100: SPARK PLUG
200: ENGINE HEAD
201: MOUNTING HOLE
205: PERIPHERAL-PORTION-AROUND-OPENING

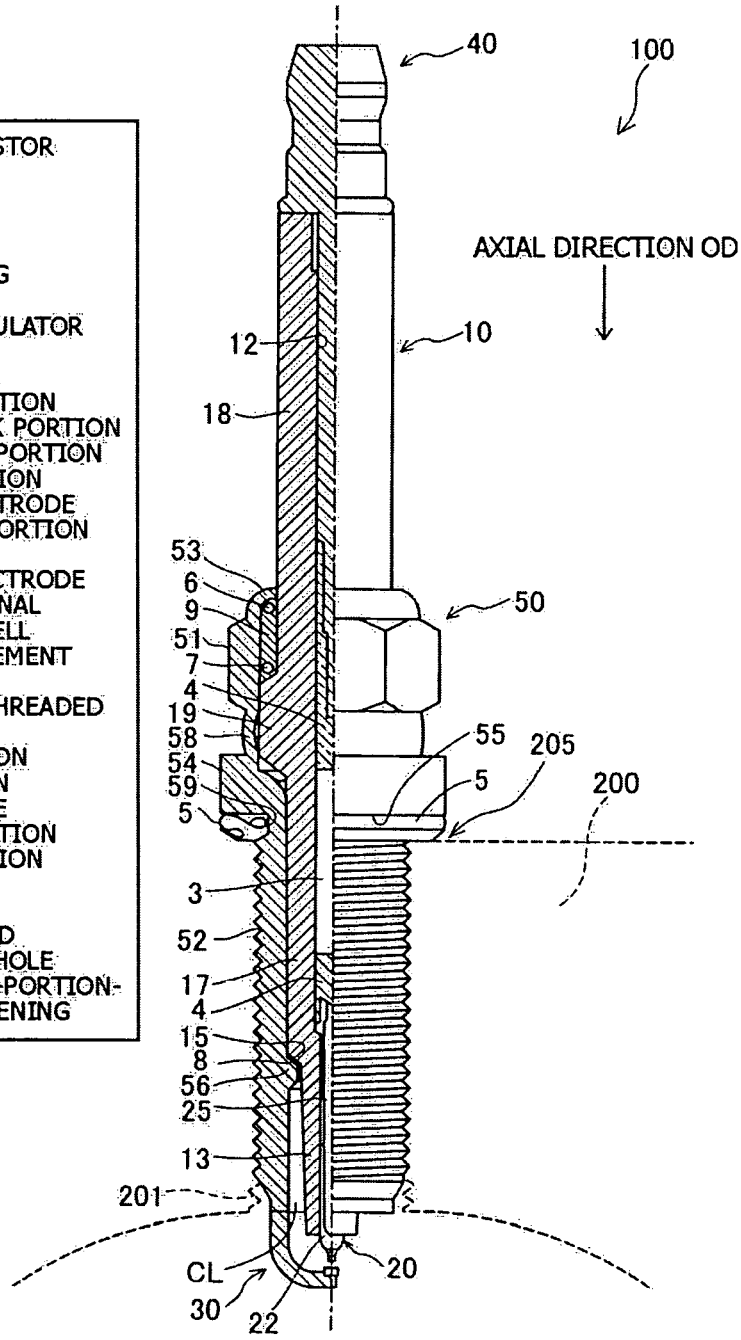

30: GROUND ELECTRODE
31: DISTAL END SURFACE
33: DISTAL END PORTION
95f: GROUND ELECTRODE TIP
98f: FUSION ZONE
100f: SPARK PLUG

30: GROUND ELECTRODE
31: DISTAL END SURFACE
33: DISTAL END PORTION
95g: GROUND ELECTRODE TIP
98g: FUSION ZONE
99g: FUSION ZONE
100g: SPARK PLUG

30: GROUND ELECTRODE
31: DISTAL END SURFACE
33: DISTAL END PORTION
95h: GROUND ELECTRODE TIP
98h: FUSION ZONE
99h: FUSION ZONE
100h: SPARK PLUG

30k: GROUND ELECTRODE
31k: DISTAL END SURFACE
33k: DISTAL END PORTION
35k: GROOVE PORTION
90: CENTER ELECTRODE TIP
93: SIDE SURFACE
95k: GROUND ELECTRODE TIP
96k: DISCHARGE SURFACE
98k: FUSION ZONE
100k: SPARK PLUG

SPARK PLUG

FIELD OF THE INVENTION

The present invention relates to a spark plug.

BACKGROUND OF THE INVENTION

Conventionally known methods of joining a noble metal tip to a ground electrode of a spark plug are disclosed in, for example, PCT Application Laid-Open No. 2004-517459 and US Patent Application Publication No. 2007/0103046.

According to the method disclosed in PCT Application Laid-Open No. 2004-517459, a noble metal tip is completely melted and joined to a ground electrode. This method can increase the welding strength between the ground electrode and the noble metal tip, but involves a problem of a deterioration in spark endurance, since the discharge surface of the noble metal tip contains components of a ground electrode base metal as a result of fusion.

Also, according to the method disclosed in US Patent Application Publication No. 2007/0103046, a peripheral portion of a noble metal tip is melted, thereby joining the noble metal tip to a ground electrode. This method, however, involves the following problem: the welding strength between the ground electrode and a central portion of the noble metal tip is weak, and cracking may be generated in the noble metal tip or a fusion zone, potentially resulting in separation of the noble metal tip.

Also, a method which uses resistance welding is known for joining a noble metal tip to a ground electrode. This method, however, involves the following problem: since the layer of a fusion zone at the interface between the ground electrode and the noble metal tip is thin, welding strength fails to cope with severe operating conditions, such as with respect to a spark plug that is increased in temperature because of the recent tendency toward higher engine outputs. Such operating conditions can potentially result in separation of the noble metal tip.

SUMMARY OF THE INVENTION

The present invention has been conceived to solve the conventional problems mentioned above. An advantage of the present invention is a technique for improving the welding strength between a ground electrode and a noble metal tip.

To solve, at least partially, the above problems, the present invention can be embodied in the following modes or application examples.

APPLICATION EXAMPLE 1

According to a first aspect of the present invention, there is provided a spark plug comprising an insulator having an axial hole extending therethrough in an axial direction. A center electrode is provided at a front end portion of the axial hole. A substantially tubular metallic shell holds the insulator. A ground electrode has one end attached to a front end portion of the metallic shell and the other end faces a front end portion of the center electrode. A noble metal tip is provided on a surface of the ground electrode which faces the front end portion of the center electrode, and forms a spark discharge gap in cooperation with the center electrode. The spark plug is characterized in that: a fusion zone is formed at least a portion of the boundary between the ground electrode and the noble metal tip through fusion of a portion of the ground electrode and a portion of the noble metal tip; and when A represents the thickness of the thickest portion of the fusion zone as measured along the axial direction, and B represents the length of the longest portion of the fusion zone as measured along the longitudinal direction of the ground electrode, the relation $1.5 \leq B/A$ is satisfied.

APPLICATION EXAMPLE 2

In accordance with a second aspect of the present invention, there is provided a spark plug as described above in application example 1, wherein when the fusion zone is cut by a plane which passes through the center axis of the ground electrode and is in parallel with the axial direction, a portion of the fusion zone which has a thickness of A/1.3 is located within a range B/2 extending from the back end of the fusion zone with respect to a melting direction.

APPLICATION EXAMPLE 3

In accordance with a third aspect of the present invention, there is provided a spark plug as described above in application examples 1 or 2, wherein when C represents the length of the noble metal tip along the longitudinal direction of the ground electrode, the relation $C \leq B$ is satisfied.

APPLICATION EXAMPLE 4

In accordance with a fourth aspect of the present invention, there is provided a spark plug comprising an insulator having an axial hole extending therethrough in an axial direction. A center electrode is provided at a front end portion of the axial hole. A substantially tubular metallic shell holds the insulator. A ground electrode has one end attached to a front end portion of the metallic shell and the other end faces a side surface of the center electrode. A noble metal tip is provided on a surface of the ground electrode which faces the side surface of the center electrode, and forms a spark discharge gap in cooperation with the center electrode. The spark plug is characterized in that: a fusion zone is formed at least a portion of the boundary between the ground electrode and the noble metal tip through fusion of a portion of the ground electrode and a portion of the noble metal tip; and the thickness of the fusion zone as measured along the longitudinal direction of the ground electrode increases frontward with respect to the axial direction.

APPLICATION EXAMPLE 5

In accordance with a fifth aspect of the present invention, there is provided a spark plug as described above in application example 4, wherein the weld zone has a width perpendicular to the axial direction and to the longitudinal direction of the ground electrode, and the width of the fusion zone increases frontward with respect to the axial direction.

APPLICATION EXAMPLE 6

In accordance with a sixth aspect of the present invention, there is provided a spark plug as described above in application examples 4 or 5, wherein when D represents the thickness of the thickest portion of the fusion zone as measured along the longitudinal direction of the ground electrode, and E represents the length of the longest portion of the fusion zone as measured along the axial direction, the relation $1.5 \leq E/D$ is satisfied.

APPLICATION EXAMPLE 7

In accordance with a seventh aspect of the present invention, there is provided a spark plug as described in application example 6, wherein when the fusion zone is cut by a plane which passes through the center axis of the ground electrode and is in parallel with the axial direction. A portion of the fusion zone which has a thickness of D/1.3 is located within a range E/2 extending from the back end of the fusion zone with respect to a melting direction.

APPLICATION EXAMPLE 8

In accordance with an eighth aspect of the present invention, there is provided a spark plug as described above in any one of application examples 4 to 7, wherein, when E represents the length of the longest portion of the fusion zone as measured along the axial direction, and F represents the length of the noble metal tip as measured along the axial direction, the relation F≤E is satisfied.

APPLICATION EXAMPLE 9

In accordance with a ninth aspect of the present invention, there is provided a spark plug as described above in any one of application examples 1 to 8, wherein the noble metal tip has a discharge surface which forms the spark discharge gap in cooperation with the center electrode. At least a portion of the noble metal tip is fitted in a groove portion formed in the ground electrode. The fusion zone for connecting the groove portion and the noble metal tip is formed at such a portion of the boundary between the groove portion and the noble metal tip that is perpendicular to the discharge surface of the noble metal tip.

APPLICATION EXAMPLE 10

In accordance with a tenth aspect of the present invention, there is provided a spark plug as described above in any one of application examples 1 to 9, wherein the fusion zone is not formed on a surface of the noble metal tip which faces the center electrode.

APPLICATION EXAMPLE 11

In accordance with an eleventh aspect of the present invention, there is provided a spark plug as described above in any one of application examples 1 to 10, wherein when L1 represents a depth from a discharge surface of the noble metal tip to a portion of the fusion zone located closest to the discharge surface, and L2 represents a depth from the discharge surface of the noble metal tip to a portion of the fusion zone located most distant from the discharge surface, the relation L2−L1≤0.3 mm is satisfied.

APPLICATION EXAMPLE 12

In accordance with a twelfth aspect of the present invention, there is provided a spark plug as described above in any one of application examples 1 to 11, wherein half or more of the boundary between the noble metal tip and a portion of the fusion zone formed on a side opposite a surface of the noble metal tip which faces the center electrode is in parallel with the discharge surface of the noble metal tip.

APPLICATION EXAMPLE 13

In accordance with a thirteenth aspect of the present invention, there is provided a spark plug as described above in any one of application examples 1 to 12, wherein the fusion zone is formed through radiation of a high-energy beam toward the boundary between the ground electrode and the noble metal tip from a direction parallel to the boundary.

APPLICATION EXAMPLE 14

In accordance with a fourteenth aspect of the present invention, there is provided a spark plug as described above in any one of application examples 1 to 13, wherein the fusion zone is formed through radiation of a high-energy beam toward the boundary between the ground electrode and the noble metal tip from a direction oblique to the boundary.

APPLICATION EXAMPLE 15

In accordance with a fifteenth aspect of the present invention, there is provided a spark plug as described above in any one of application examples 1 to 14, wherein the fusion zone is formed through radiation of a fiber laser beam or an electron beam toward the boundary between the ground electrode and the noble metal tip.

The present invention can be implemented in various forms. For example, the present invention can be implemented in a method of manufacturing a spark plug, an apparatus for manufacturing a spark plug, and a system of manufacturing a spark plug.

According to a spark plug of application example 1, the generation of oxide scale is restrained, whereby the welding strength between the noble metal tip and the ground electrode can be improved.

According to a spark plug of application example 2, an increase in the spark discharge gap (discharge gap) caused by spark-induced erosion can be restrained, whereby the durability of the spark plug can be improved.

According to a spark plug of application example 3, since the noble metal tip and the ground electrode can be welded via the fusion zone at a wide portion of the boundary therebetween, the welding strength between the noble metal tip and the ground electrode can be enhanced.

According to a spark plug of application example 4, since stress imposed on the ground electrode can be appropriately mitigated, the generation of oxide scale is restrained, whereby the separation of the noble metal tip from the ground electrode can be restrained.

According to a spark plug of application example 5, since stress imposed on the ground electrode can be appropriately mitigated, the generation of oxide scale is restrained, whereby the separation of the noble metal tip from the ground electrode can be restrained.

According to a spark plug of application example 6, the generation of oxide scale in the vicinity of the fusion zone can be restrained.

According to a spark plug of application example 7, an increase in spark discharge gap caused by spark-induced erosion can be restrained, whereby the durability of the spark plug can be improved.

According to a spark plug of application example 8, since the noble metal tip and the ground electrode can be welded via the fusion zone at a wide portion of the boundary therebetween, the welding strength between the noble metal tip and the ground electrode can be enhanced.

According to a spark plug of application example 9, since the noble metal tip and the ground electrode can be welded via the fusion zone at a wider portion of a region therebetween, the welding strength between the noble metal tip and the ground electrode can be further enhanced.

According to a spark plug of application example 10, since the noble metal tip is superior to the weld zone in resistance to spark-induced erosion, resistance to spark-induced erosion can be improved.

According to a spark plug of application example 11, the amount of an increase in discharge gap in the course of use of the spark plug can be restrained, whereby the durability of the noble metal tip can be further improved.

According to a spark plug of application example 12, since an unmelted portion of the noble metal tip increases in volume, resistance to spark-induced erosion can be improved.

According to a spark plug of application example 13, since a high-energy beam can meltingly and deeply penetrate an irradiated object, the fusion zone having an appropriate shape can be formed through radiation even from such a direction.

According to a spark plug of application example 14, the fusion zone having an appropriate shape can be formed through radiation even from such a direction.

According to a spark plug of application example 15, by use of a fiber laser beam or an electron beam as a high-energy beam, the ground electrode and the noble metal tip can be melted deeply along the boundary therebetween; therefore, the ground electrode and the noble metal tip can be strongly joined together.

BRIEF DESCRIPTION OF THE DRAWINGS

FIG. 1 is a partially sectional view showing a spark plug 100 according to an embodiment of the present invention.

DETAILED DESCRIPTION OF PREFERRED EMBODIMENT

Figure 2:
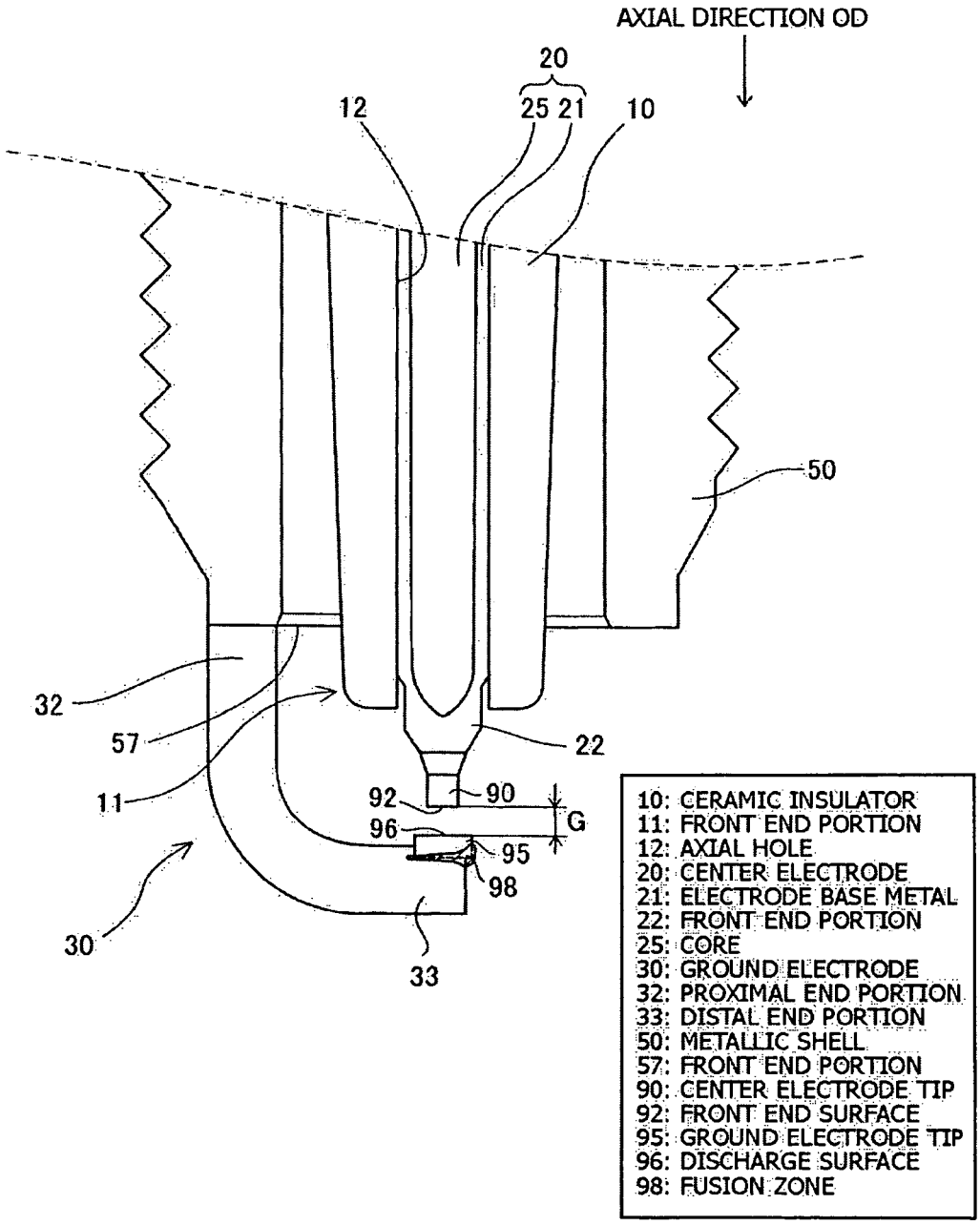
FIG. 2 is an enlarged view showing a front end portion 22 of a center electrode 20 and its periphery of the spark plug 100.

Embodiments of a spark plug according to a mode for carrying out the present invention will next be described in the following order. A. First embodiment; B. Second embodiment; C. Third embodiment; D. Fourth embodiment; E. Example experiment on temperature of electrode; F. Example experiment on oxide scale; G. Example experiment on amount of increase in gap G; and H. Other embodiments.

A. First Embodiment

A1. Structure of Spark Plug:

FIG. 1 is a partially sectional view showing a spark plug 100 according to an embodiment of the present invention. In the following description, an axial direction OD of the spark plug 100 in FIG. 1 is referred to as the vertical direction, and the lower side of the spark plug 100 in FIG. 1 is referred to as the front side of the spark plug 100, and the upper side as the rear side.

The spark plug 100 includes a ceramic insulator 10, a metallic shell 50, a center electrode 20, a ground electrode 30, and a metal terminal 40. The center electrode 20 is held in the ceramic insulator 10 while extending in the axial direction OD. The ceramic insulator 10 functions as an insulator. The metallic shell 50 holds the ceramic insulator 10. The metal terminal 40 is provided at a rear end portion of the ceramic insulator 10. The construction of the center electrode 20 and the ground electrode 30 will be described in detail later with reference to FIG. 2.

The ceramic insulator 10 is formed from alumina, etc. through firing and has a tubular shape such that an axial hole 12 extends therethrough coaxially along the axial direction OD. The ceramic insulator 10 has a flange portion 19 having the largest outside diameter. Flange portion 19 is located substantially at the center with respect to the axial direction OD. A rear trunk portion 18 is located rearward (upward in FIG. 1) of the flange portion 19. The ceramic insulator 10 also has a front trunk portion 17 that is smaller in outside diameter than the rear trunk portion 18 and that is located frontward (downward in FIG. 1) of the flange portion 19. A leg portion 13 smaller in outside diameter than the front trunk portion 17 is located frontward of the front trunk portion 17. The leg portion 13 is reduced in diameter in the frontward direction and is exposed to a combustion chamber of an internal combustion engine when the spark plug 100 is mounted to an engine head 200 of the engine. A stepped portion 15 is formed between the leg portion 13 and the front trunk portion 17.

The metallic shell 50 is a cylindrical metallic member formed of low-carbon steel and is adapted to fix, i.e., attach, the spark plug 100 to the engine head 200 of the internal combustion engine. The metallic shell 50 holds the ceramic insulator 10 therein while surrounding a region of the ceramic insulator 10 extending from a portion of the rear trunk portion 18 to the leg portion 13.

The metallic shell 50 has a tool engagement portion 51 and a mounting threaded portion 52. The tool engagement portion 51 allows a spark plug wrench (not shown) to be fitted thereto. The mounting threaded portion 52 of the metallic shell 50 has threads formed thereon. Threaded portion 52 is dimensioned to threadingly engage with a mounting threaded hole 201 of the engine head 200 provided at an upper portion of an internal combustion engine.

The metallic shell 50 has a flange-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral-portion-around-opening 205 of the mounting threaded hole 201. The deformation of the gasket 5 provides a seal between the spark plug 100 and the engine head 200, thereby preventing gas leakage from inside the engine via the mounting threaded hole 201.

The metallic shell 50 has a thin-walled crimp portion 53 located rearward of the tool engagement portion 51. The metallic shell 50 also has a buckle portion 58, which is thin-walled similar to the crimp portion 53, between the seal portion 54 and the tool engagement portion 51. Annular ring members 6 and 7 are disposed between an outer circumferential surface of the rear trunk portion 18 of the ceramic insulator 10 and an inner circumferential surface of the metallic shell 50 extending from the tool engagement portion 51 to the crimp portion 53. Further, a space between the two ring members 6 and 7 is filled with a powder of talc 9. When the crimp portion 53 is crimped inward, the ceramic insulator 10 is pressed frontward within the metallic shell 50 via the ring members 6 and 7 and the talc 9. Accordingly, the stepped portion 15 of the ceramic insulator 10 is supported by a stepped portion 56 formed on the inner circumference of the metallic shell 50, whereby the metallic shell 50 and the ceramic insulator 10 are united together. At this time, gastightness between the metallic shell 50 and the ceramic insulator 10 is maintained by means of an annular sheet packing 8 which intervenes between the stepped portion 15 of the ceramic insulator 10 and the stepped portion 56 of the metallic shell 50, thereby preventing outflow of combustion gas. The buckle portion 58 is designed to be deformed outwardly in association with application of compressive force in a crimping process, thereby contributing toward increasing the length of compression of the talc 9 and thus enhancing the gastightness of the interior of the metallic shell 50. A clearance CL having a predetermined dimension is provided between the ceramic insulator 10 and a portion of the metallic shell 50 located frontward of the stepped portion 56.

FIG. 2 is an enlarged view showing a front end portion 22 of the center electrode 20 and its periphery of the spark plug 100. The center electrode 20 is a rodlike electrode having a structure in which a core 25 is embedded within an electrode base metal 21. The electrode base metal 21 is formed of nickel or an alloy which contains Ni as a main component, such as INCONEL (trade name) 600 or 601. The core 25 is formed of copper or an ally which contains Cu as a main component, copper and the alloy being superior in thermal conductivity to the electrode base metal 21. Usually, the center electrode 20 is fabricated as follows: the core 25 is disposed within the electrode base metal 21 which is formed into a closed-bottomed tubular shape, and the resultant assembly is drawn by extrusion from the bottom side. The core 25 is formed such that, while a trunk portion has a substantially constant outside diameter, a front end portion is tapered. The center electrode 20 extends rearward through the axial hole 12 and is electrically connected to the metal terminal 40 (FIG. 1) via a seal body 4 and a ceramic resistor 3 (FIG. 1). A high-voltage cable (not shown) is connected to the metal terminal 40 via a plug cap (not shown) for applying high voltage to the metal terminal 40.

The front end portion 22 of the center electrode 20 projects from a front end portion 11 of the ceramic insulator 10. A center electrode tip 90 is joined to the front end surface of the front end portion 22 of the center electrode 20. The center electrode tip 90 has a substantially circular columnar shape extending in the axial direction OD and is formed of a noble metal having high melting point in order to improve resistance to spark-induced erosion. The center electrode tip 90 is formed of, for example, iridium (Ir) or an Ir alloy which contains Ir as a main component and an additive of one or more elements selected from among platinum (Pt), rhodium (Rh), ruthenium (Ru), palladium (Pd), and rhenium (Re).

The ground electrode 30 is formed of a metal having high corrosion resistance, such as by way of example and not limitation, an Ni alloy, such as INCONEL (trade name) 600 or 601. A proximal end portion 32 of the ground electrode 30 is joined to a front end portion 57 of the metallic shell 50 by welding. Also, the ground electrode 30 is bent such that a distal end portion 33 thereof faces the front end portion 22 of the center electrode 20 and also faces a front end surface 92 of the center electrode tip 90.

Further, a ground electrode tip 95 is joined to the distal end portion 33 of the ground electrode 30 via a fusion zone 98. A discharge surface 96 of the ground electrode tip 95 faces the front end surface 92 of the center electrode tip 90. A gap G is formed between the discharge surface 96 of the ground electrode tip 95 and the front end surface 92 of the center electrode tip 90. The ground electrode tip 95 can be formed from a material similar to that used to form the center electrode tip 90.

Figure 3A:
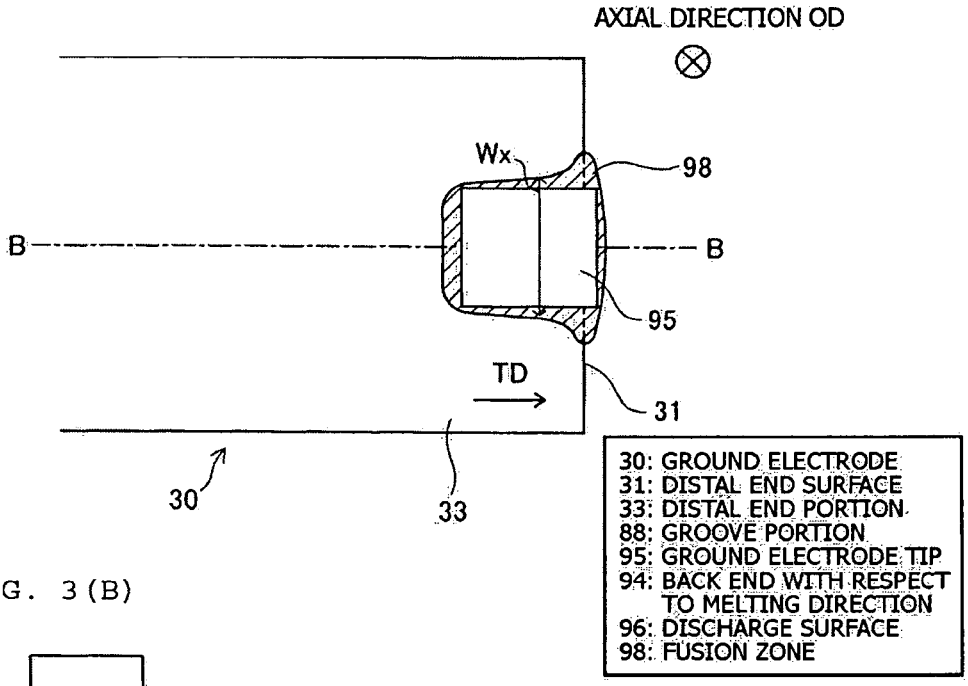
FIG. 3(A) is an explanatory view showing the shape of a fusion zone 98 in a first embodiment of the present invention as viewed from the axial direction.
Figure 3B:
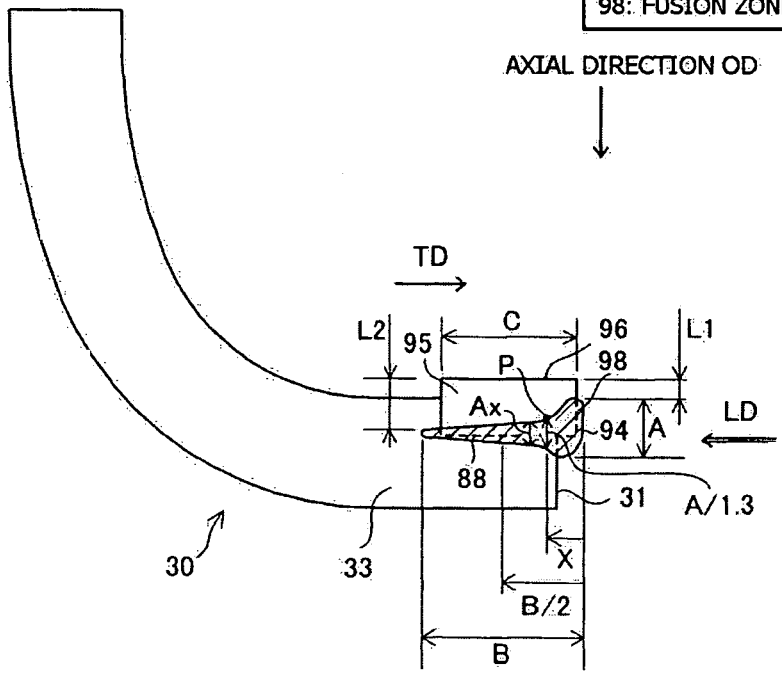
FIG. 3(B) is a sectional view taken along line B-B of FIG. 3(A).

A2. Shapes and Dimensions of Components:

FIG. 3(A) is a view of the distal end portion 33 of the ground electrode 30 as viewed from the axial direction OD. FIG. 3(B) is a sectional view taken along line B-B of FIG. 3(A). As shown in FIG. 3(B), the ground electrode tip 95 is fitted in a groove portion 88 formed in the ground electrode 30. The fusion zone 98 is formed along at least a portion of the boundary between the ground electrode tip 95 and the ground electrode 30. The fusion zone 98 is formed through fusion of a portion of the ground electrode tip 95 and a portion of the ground electrode 30 and contains components of the ground electrode tip 95 and the ground electrode 30. Thus, the fusion zone 98 has an intermediate composition between the ground electrode 30 and the ground electrode tip 95. In actuality, most of the fusion zone 98 is invisible from the axial direction OD; however, for convenience of description, the fusion zone 98 is illustrated in FIG. 3(A). The same also applies to the drawings referred to in the following description. A broken line appears at the boundary between the ground electrode tip 95 and the ground electrode 30 (FIG. 3(B)); however, in actuality, in the fusion zone 98, the ground electrode tip 95 and the ground electrode 30 are fused together, and the boundary represented by the broken line does not exist. The same also applies to the drawings referred to in the following description.

The fusion zone 98 can be formed through radiation of a high-energy beam from a direction LD substantially parallel to the boundary between the ground electrode 30 and the ground electrode tip 95. Preferably, a fiber laser beam or an electron beam, for example, is used as the high-energy beam for forming the fusion zone 98. Particularly, the fiber laser beam can deeply melt the ground electrode 30 and the ground electrode tip 95 along the boundary therebetween. Thus, the ground electrode 30 and the ground electrode tip 95 can be firmly joined together.

Preferably, as shown in FIG. 3(B), the thickness Ax of the fusion zone 98 as measured along a direction perpendicular to the discharge surface 96 of the ground electrode tip 95 increases along a direction TD oriented toward the distal end of the ground electrode 30 (hereinafter, may be referred to as the longitudinal direction TD of the ground electrode 30). As will be described later, in a state where the spark plug 100 is in service, the temperature of the ground electrode 30 increases gradually along the direction TD oriented toward the distal end of the ground electrode 30. Thus, the closer to a distal end surface 31 of the ground electrode, the greater the stress imposed on the ground electrode 30. Since the fusion zone 98 has an intermediate thermal expansion coefficient between those of the ground electrode 30 and the ground electrode tip 95, stress imposed on the ground electrode 30 can be mitigated. Thus, by means of the thickness Ax of the fusion zone 98 being gradually increased along the direction TD oriented toward the distal end of the ground electrode 30, stress imposed on the ground electrode 30 can be appropriately mitigated. Therefore, the generation of oxide scale is restrained, whereby the separation of the ground electrode tip 95 from the ground electrode 30 can be restrained. In other words, preferably, the higher the temperature of a portion of the ground electrode 95 in a state where the spark plug 100 is in service, the greater the thickness Ax of the fusion zone 98 as measured, at an associated position, along a direction perpendicular to the discharge surface 96 of the ground electrode tip 95.

Similarly, preferably, as shown in FIG. 3(A), a width Wx of the fusion zone 98 as measured along a direction in parallel with the distal end surface 31 of the ground electrode 30 and in parallel with the discharge surface 96 of the ground electrode tip 95 increases gradually along the direction TD oriented toward the distal end of the ground electrode 30. This is for the same reason as that for gradually increasing the thickness Ax of the fusion zone 98 along the direction TD oriented toward the distal end of the ground electrode 30 as mentioned above. Since, through employment of such the width Wx, stress imposed on the ground electrode 30 can be appropriately mitigated, the generation of oxide scale is restrained, whereby the separation of the ground electrode tip 95 from the ground electrode 30 can be restrained.

Also, as shown in FIG. 3(B), A represents the thickness of the thickest portion of the fusion zone 98 as measured along a direction perpendicular to the discharge surface 96 of the ground electrode tip 95. In other words, A represents the thickness of the thickest portion of the fusion zone 98 as measured along the axial direction OD. Further, B represents the length of the longest portion of the fusion zone 98 as measured along a direction perpendicular to the distal end surface 31 of the ground electrode 30. In other words, B represents the length of the longest portion of the fusion zone 98 as measured along the longitudinal direction TD of the ground electrode 30. In this case, preferably, the spark plug 100 satisfies the following relational expression (1).

$$1.5 \leq B/A \quad (1)$$

Through satisfaction of the above relational expression (1), the generation of oxide scale in the vicinity of the fusion zone 98 can be restrained. The reason for this will be described later. Hereinafter, B/A may be referred to as the fusion zone ratio.

Further, preferably, as shown in FIG. 3(B), when the fusion zone 98 is cut by a plane which passes through the center axis (B-B axis) of the ground electrode 30 and is in parallel with the axial direction OD, a portion P of the fusion zone 98 which has a thickness Ax of A/1.3 is located within a range of B/2 extending from a back end 94 of the fusion zone 98 with respect to a melting direction. That is, preferably, a distance X from the back end 94 of the fusion zone 98 with respect to the melting direction to the portion P of the fusion zone 98 which has a thickness Ax of A/1.3 is B/2 or less. By means of the fusion zone 98 having such a shape, an increase in the gap G caused by spark-induced erosion can be restrained, whereby the durability of the spark plug can be improved. The reason for this is as follows.

When the portion P of the fusion zone 98 which has a thickness of A/1.3 is located on a side, with respect to the position of B/2, toward the leading end of the fusion zone 98 with respect to the melting direction and is closer to the leading end (the portion P is located at the position of B/1.4, etc.), the fusion zone 98 is more likely to appear from the discharge surface in the course of erosion of the ground electrode tip 95 caused by spark discharge; therefore, the gap G is more likely to increase. By contrast, when the portion P of the fusion zone 98 which has a thickness of A/1.3 is located on a side, with respect to the position of B/2, toward the back end 94 with respect to the melting direction (the portion P is located at the position of B/2, B/3, etc.), the fusion zone 98 is unlikely to appear from the discharge surface, so that the amount of an increase in the gap G can be restrained.

Further, preferably, as shown in FIG. 3(B), the ground electrode tip 95 is fitted in the groove portion 88 formed in the ground electrode 30. C represents the length of the ground electrode tip 95 as measured along a direction perpendicular to the distal end surface 31 of the ground electrode 30. In other words, C represents the length of the ground electrode tip 95 as measured along the longitudinal direction TD of the ground electrode 30. Also, as mentioned above, B represents the length of the longest portion of the fusion zone 98 as measured along the direction perpendicular to the distal end surface 31 of the ground electrode 30. In other words, B represents the length of the longest portion of the fusion zone 98 as measured along the longitudinal direction TD of the ground electrode 30. In this case, preferably, the spark plug 100 satisfies the following relational expression (2).

$$C \leq B \quad (2)$$

Through satisfaction of the above relation, since the ground electrode tip 95 and the ground electrode 30 can be welded via the fusion zone 98 at a wide portion of the boundary (i.e., interface) therebetween, the welding strength between the ground electrode tip 95 and the ground electrode 30 can be enhanced.

Also, preferably, as shown in FIG. 3(B), the fusion zone 98 is not formed on the discharge surface 96 of the ground electrode tip 95. In other words, the fusion zone 98 is not formed on the surface 96 of the ground electrode tip 95 which faces the center electrode 20. The reason for this is that the ground electrode tip 95 is superior to the fusion zone 98 in resistance to spark-induced erosion. Therefore, by means of the fusion zone 98 being not formed on the discharge surface 96 of the ground electrode tip 95, resistance to spark-induced erosion can be improved.

Further, as shown in FIG. 3(B), L1 represents a depth from the discharge surface 96 of the ground electrode tip 95 to such a portion of the boundary between the fusion zone 98 and the ground electrode tip 95 that is located closest to the discharge surface 96. L2 represents a depth from the discharge surface 96 of the ground electrode tip 95 to such a portion of the boundary between the fusion zone 98 and the ground electrode tip 95 that is located most distant from the discharge surface 96. In this case, preferably, the spark plug 100 satisfies the following relational expression (3).

$$L2-L1 \leq 0.3 \text{ mm} \quad (3)$$

Through satisfaction of the above relation, the amount of an increase in the discharge gap G in the course of use of the spark plug 100 can be restrained, and the durability of the ground electrode tip 95 can be further improved. Grounds for specification of the above relational expression (3) will be described later. Hereinafter, the difference "L2−L1" may be referred to as the fusion-zone level difference LA (LA=L2−L1).

B. Second Embodiment

Figure 4:
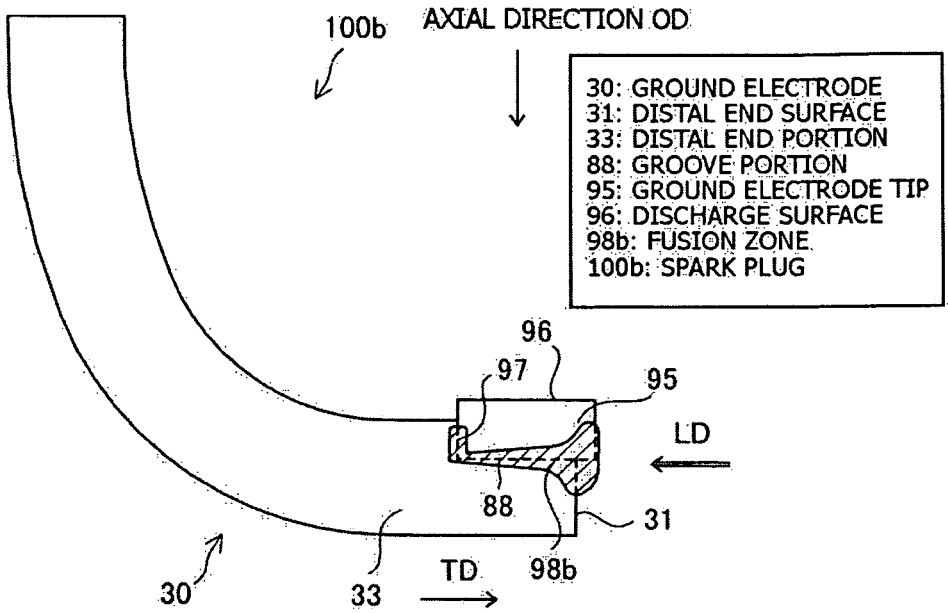
FIG. 4 is an explanatory view showing the sectional shape of a fusion zone 98*b* in a second embodiment of the present invention.

FIG. 4 is an explanatory view showing the sectional shape of a fusion zone 98*b* of a spark plug 100*b* according to a second embodiment of the present invention. Preferably, at least a portion of the ground electrode tip 95 is fitted in the groove portion 88 formed in the ground electrode 30, and the fusion zone 98*b* is also formed at such a portion 97 (the boundary 97) of a region between the groove portion of the ground electrode 30 and the ground electrode tip 95 that is substantially perpendicular to the discharge surface 96 of the ground electrode tip 95. Since, through employment of such the feature, the ground electrode tip 95 and the ground electrode 30 can be welded via the fusion zone 98*b* along a wider portion of the boundary (i.e., interface) therebetween, the welding strength between the ground electrode tip 95 and the ground electrode 30 can be further enhanced.

The fusion zone 98*b* having such a shape can be formed by increasing the time of radiation of a fiber laser beam or an electron beam in relation to the case of forming the fusion zone 98 shown in FIG. 3(B). Alternatively, the fusion zone 98*b* can be formed by increasing the radiation output of a fiber laser beam or an electron beam.

C. Third Embodiment

Figure 5:
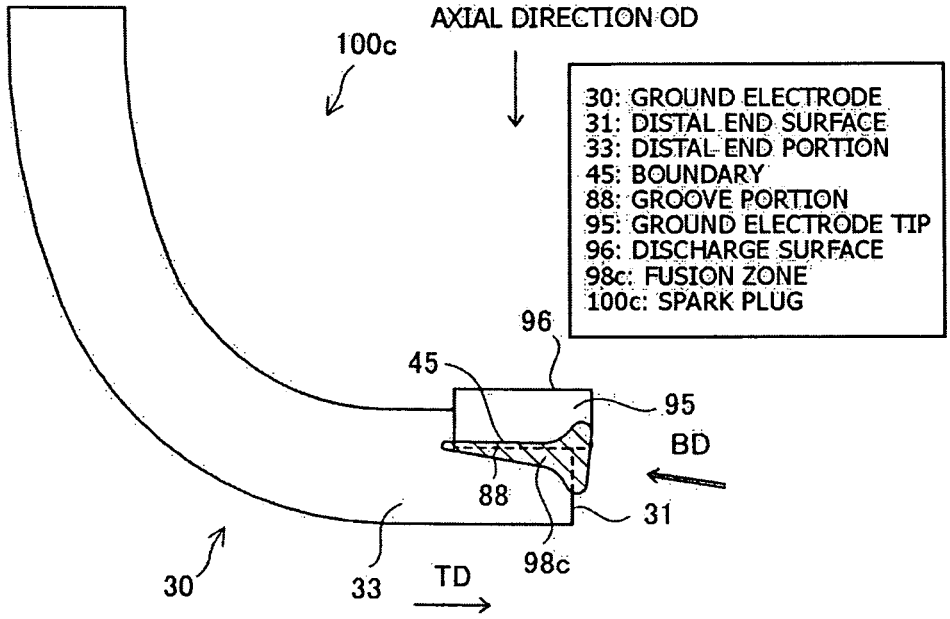
FIG. 5 is an explanatory view showing the sectional shape of a fusion zone 98*c* in a third embodiment of the present invention.

FIG. 5 is an explanatory view showing the sectional shape of a fusion zone 98*c* of a spark plug 100*c* according to a third embodiment of the present invention. Preferably, as shown in FIG. 5, half or more of the boundary 45 between the ground electrode tip 95 and a portion of the fusion zone 98*c* formed on a side opposite the surface 96 (the discharge surface 96) of the ground electrode tip which faces the center electrode 20 is in parallel with the discharge surface 96 of the ground electrode tip 95. Since employment of such the feature increases the volume of such a portion of the ground electrode tip 95 that is not melted by a fiber laser beam or the like, resistance to spark-induced erosion can be improved.

The fusion zone 98*c* having such a shape can be formed through radiation of a fiber laser beam or an electron beam toward the boundary between the ground electrode 30 and the ground electrode tip 95 from a direction BD oblique to the boundary.

D. Fourth Embodiment

Figure 6A:
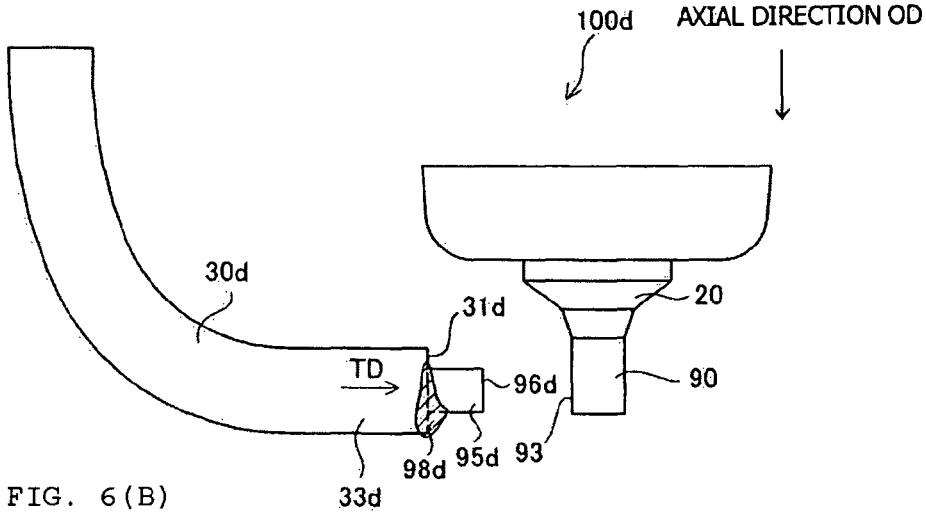
FIGS. 6(A), 6(B) and 6(C) are sets of explanatory views showing a distal end portion 33*d* of a ground electrode 30*d* and its periphery of a spark plug 100*d* according to a fourth embodiment of the present invention.
Figure 6B:
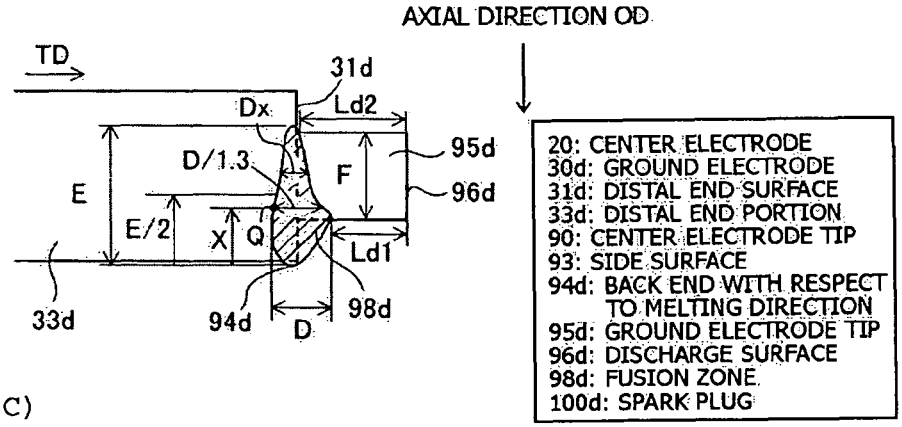
Figure 6C:
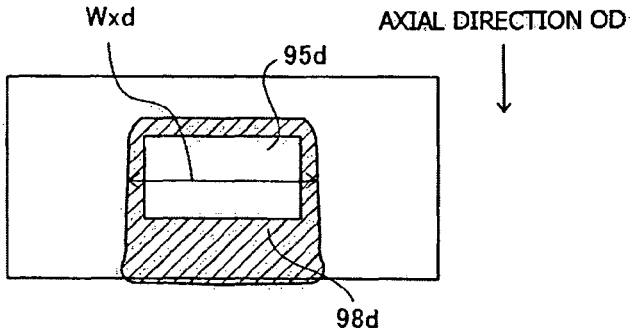

FIG. 6(A) is an explanatory view showing a distal end portion 33*d* and its periphery of a ground electrode 30*d* of a spark plug 100*d* according to a fourth embodiment of the present invention. FIG. 6(B) is an explanatory view showing, on an enlarged scale, the distal end portion 33*d* of the ground electrode 30*d*. FIG. 6(C) is a view showing a ground electrode tip 95*d* as viewed from a direction perpendicular to a discharge surface 96*d*.

In the spark plug 100*d*, a distal end surface 31*d* of the ground electrode 30*d* faces a side surface 93 of the center electrode tip 90. Assuming that the center electrode tip 90 is a portion of the center electrode 20, the distal end portion 33*d* of the ground electrode 30*d* can be said to face the side surface 93 of the center electrode 20. That is, the spark plug 100*d* is a so-called lateral-discharge-type plug, and the discharge direction is perpendicular to the axial direction OD.

As shown in FIG. 6(A), the ground electrode tip 95*d* is provided on the surface 31*d* of the ground electrode 30*d* which faces the side surface 93 of the center electrode 20 (the side surface 93 of the center electrode tip 90), and forms a spark discharge gap in cooperation with the center electrode 20 (the center electrode tip 90). A fusion zone 98*d* is formed along at least a portion of the boundary between the ground electrode 30*d* and the ground electrode tip 95*d* through fusion of the ground electrode 30*d* and the ground electrode tip 95*d*.

Preferably, as shown in FIG. 6(B), the thickness Dx of the fusion zone 98*d* as measured along a direction perpendicular to the discharge surface 96*d* of the ground electrode tip 95*d* increases along the axial direction OD. In other words, preferably, the thickness Dx of the fusion zone 98*d* along the longitudinal direction TD of the ground electrode 30*d* increases frontward with respect to the axial direction OD of the spark plug 100*d*. The reason for this is that the temperature in the vicinity of the distal end surface 31*d* of the ground electrode 30*d* of the lateral-discharge-type plug increases along the axial direction OD. Therefore, similarly to the case of the spark plug 100 shown in FIG. 3(B), since, by means of the fusion zone 98*d* having such a shape, stress imposed on the ground electrode 30 can be appropriately mitigated, the generation of oxide scale is restrained, whereby the separation of the ground electrode tip 95*d* from the ground electrode 30*d* can be restrained.

Similarly, preferably, as shown in FIG. 6(C), a width Wxd of the fusion zone 98*d* as measured along a direction perpendicular to the axial direction OD of the spark plug 100*d* and in parallel with the discharge surface 96*d* of the ground electrode tip 95*d* increases gradually along the axial direction OD of the spark plug 100*d*. In other words, preferably, the width Wxd of the fusion zone 98*d* along a direction perpendicular to the axial direction OD and perpendicular to the longitudinal direction TD of the ground electrode 30*d* increases frontward with respect to the axial direction OD. Similarly to the case of the spark plug 100 shown in FIG. 3(A), since, through employment of such the width Wxd, stress imposed on the ground electrode 30 can be appropriately mitigated, the generation of oxide scale is restrained, whereby the separation of the ground electrode tip 95*d* from the ground electrode 30*d* can be restrained.

Also, as shown in FIG. 6(B), D represents the thickness of the thickest portion of the fusion zone 98*d* as measured along a direction perpendicular to the discharge surface 96*d* of the ground electrode tip 95*d*. In other words, D represents the thickness of the thickest portion of the fusion zone 98*d* as measured along the longitudinal direction TD of the ground electrode 30*d*. Further, E represents the length of the longest portion of the fusion zone 98*d* as measured along the axial direction OD of the spark plug 100*d*. In this case, preferably, the spark plug 100*d* satisfies the following relational expression (4).

$$1.5 \leq E/D \quad (4)$$

Through satisfaction of the above relational expression (4), as in the case of the spark plug 100 shown in FIG. 3(B) the generation of oxide scale in the vicinity of the fusion zone 98*d* can be restrained. The reason for this is similar to that in the case of the spark plug 100 shown in FIG. 3(B) and will be described later.

Further, preferably, as shown in FIG. 6(B), when the fusion zone 98*d* is cut by a plane which passes through the center axis of the ground electrode 30*d* and is in parallel with the axial direction OD, a portion Q of the fusion zone 98*d* which has a thickness Dx of D/1.3 is located within a range between a position of E/2 and a back end 94*d* of the fusion zone 98*d* with respect to a melting direction. That is, preferably, a distance X from the back end 94*d* of the fusion zone 98*d* with respect to the melting direction to the portion Q of the fusion zone 98*d* which has a thickness Dx of D/1.3 is E/2 or less. By means of the fusion zone 98*d* having such a shape, similarly to the case of the spark plug 100 shown in FIG. 3(B), an increase in the gap G caused by spark-induced erosion can be restrained, whereby the durability of the spark plug can be improved. The reason for this is similar to that in the case of the spark plug 100 shown in FIG. 3(B).

Also, as shown in FIG. 6(B), F represents the length of the ground electrode tip 95*d* along the axial direction OD of the spark plug 100*d*. As mentioned above, E represents the length of the longest portion of the fusion zone 98*d* as measured along the axial direction OD. In this case, preferably, the spark plug 100*d* satisfies the following relational expression (5).

$$F \leq E \quad (5)$$

Through satisfaction of the above relation, similarly to the case of the spark plug 100 shown in FIG. 3(B), since the ground electrode tip 95*d* and the ground electrode 30*d* can be welded via the fusion zone 98*d* at a wide portion of the boundary therebetween, the welding strength between the ground electrode tip 95*d* and the ground electrode 30*d* can be enhanced.

Further, as shown in FIG. 6(B), Ld1 represents a depth from the discharge surface 96*d* of the ground electrode tip 95*d* to such a portion of the boundary between the fusion zone 98*d* and the ground electrode tip 95*d* that is located closest to the discharge surface 96*d*. Ld2 represents a depth from the discharge surface 96*d* of the ground electrode tip 95*d* to such a portion of the boundary between the fusion zone 98*d* and the ground electrode tip 95*d* that is located most distant from the discharge surface 96*d*. In this case, preferably, the spark plug 100*d* satisfies the following relational expression (6).

$$Ld2 - Ld1 \leq 0.3 \text{ mm} \quad (6)$$

Through satisfaction of the above relation, similarly to the case of the spark plug 100 shown in FIG. 3(B), the amount of an increase in the discharge gap G in the course of use of the spark plug 100*d* can be restrained, and the durability of the ground electrode tip 95*d* can be further improved. Grounds for specification of the above relational expression (6) are similar to those for specification of the above relational expression (3) and will be described later.

E. Example Experiment on Temperature of Electrode

An experiment was conducted on spark plugs having the configuration shown in FIG. 3, in order to study the relation between the distance from the distal end surface 31 of the ground electrode 30 and the temperature of the ground electrode 30 at the distance.

Figure 7:
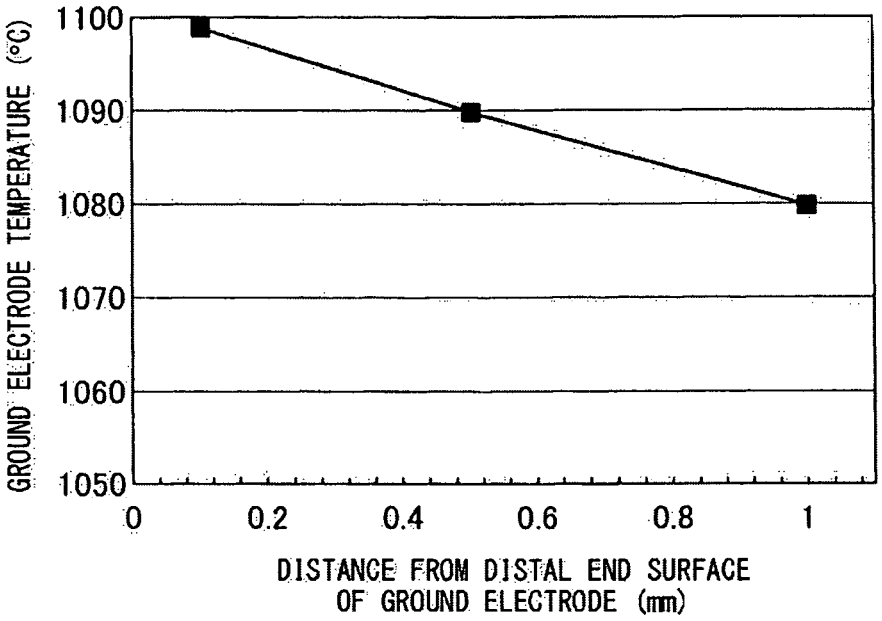
FIG. 7 is a graph showing the relation between the distance from a distal end surface 31 of a ground electrode 30 and the temperature of the ground electrode 30.

FIG. 7 is a graph showing the relation between the distance from the distal end surface 31 of the ground electrode 30 and the temperature of the ground electrode 30. The horizontal axis of FIG. 7 shows the distance from the distal end surface 31 of the ground electrode 30, whereas the vertical axis shows the temperature of the ground electrode 30 at the distance. In the present example experiment, the temperature of the ground electrode 30 was measured on a surface opposite the surface on which the ground electrode tip 95 is provided. As is understood from FIG. 7, the closer to the distal end surface 31 of the ground electrode 30, the higher the temperature; in other words, the more distant from the distal end surface 31, the lower the temperature. Therefore, as shown in FIG. 3(B), by means of increasing the thickness Ax of the fusion zone 98 with the temperature of the ground electrode 30; i.e., by means of the thickness Ax of the fusion zone 98 being gradually increased along the direction TD oriented toward the distal end of the ground electrode 30, stress imposed on the ground electrode 30 can be appropriately mitigated, whereby the generation of oxide scale can be restrained. Similarly, in the spark plug 100*d* shown in FIG. 6, preferably, the thickness Dx of the fusion zone 98*d* increases frontward with respect to the axial direction OD.

F. Example Experiment on Oxide Scale

A temperature cycle test was conducted on spark plugs having the configuration shown in FIG. 3, in order to study the relation between the fusion zone ratio B/A and the oxide scale percentage. When the temperature cycle test was conducted, oxide scale was generated in the vicinity of the fusion zone 98. The oxide scale percentage is the percentage of the length of oxide scale to the length B of the fusion zone 98 (FIG. 3(B)).

In the temperature cycle test, first, the ground electrode 30 was heated for two minutes with a burner so as to raise the temperature of the ground electrode 30 to 1,100° C. Subsequently, the burner was turned off; the ground electrode 30 was gradually cooled for one minute; and the ground electrode 30 was again heated for two minutes with the burner so as to raise the temperature of the ground electrode 30 to 1,100° C. This cycle was repeated 1,000 times. The length of oxide scale generated in the vicinity of the fusion zone 98 was measured on a section. The oxide scale percentage was obtained from the measured length of oxide scale.

Figure 8:
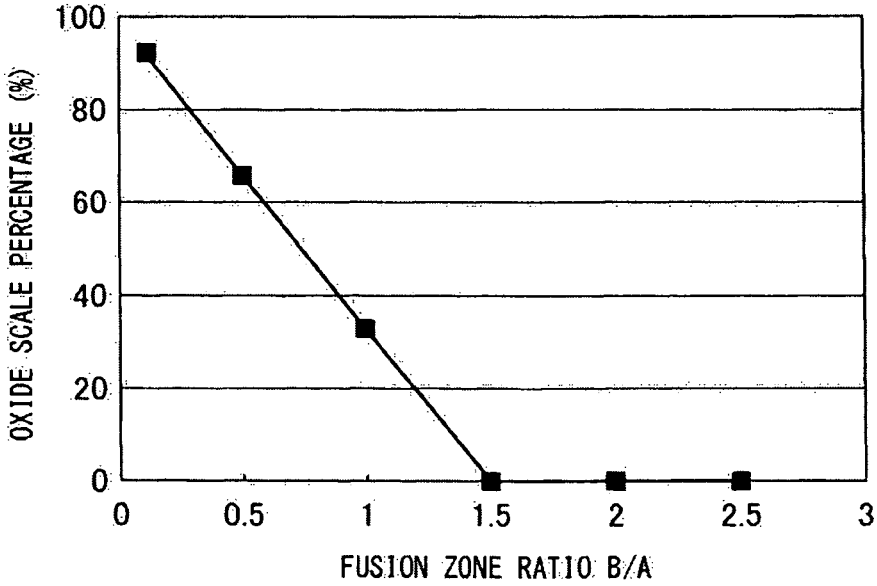
FIG. 8 is a graph showing the relation between the fusion zone ratio B/A and the oxide scale percentage.

FIG. 8 is a graph showing the relation between the fusion zone ratio B/A and the oxide scale percentage. The horizontal axis of FIG. 8 shows the fusion zone ratio B/A, whereas the vertical axis shows the oxide scale percentage. As is understood from FIG. 8, as the fusion zone ratio B/A increases, the oxide scale percentage reduces. Conceivably, this is for the following reason: as the fusion zone ratio B/A increases, the volume of such a portion of the fusion zone 98 that is formed along the interface between the ground electrode tip 95 and the ground electrode 30 increases, whereby oxide scale is less likely to be generated at the interface between the ground electrode tip 95 and the ground electrode 30. At a fusion zone ratio B/A of 1.5 or greater, the oxide scale percentage is 0%. Therefore, preferably, the fusion zone 98 is formed such that the fusion zone ratio B/A is 1.5 or greater. Similarly, in the spark plug 100*d* shown in FIG. 6, preferably, the fusion zone 98*d* is formed such that the fusion zone ratio E/D is 1.5 or greater.

G1. Example Experiment 1 on Amount of Increase in Gap G

A desk spark test was conducted on spark plug samples which have the configuration shown in FIG. 3 and differ in the fusion-zone level difference LA, in order to study the relation between the fusion-zone level difference LA (=L2−L1) and the amount of increase in the gap G after the test. In the present example experiment, discharges of a frequency of 60 Hz were performed for 100 hours in the atmosphere having a pressure of 0.4 MPa.

Figure 9A:
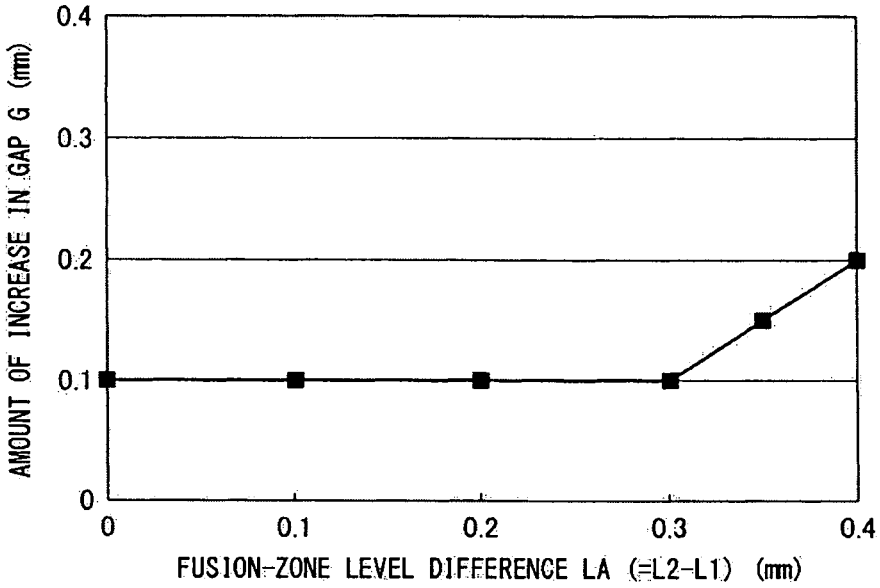
FIGS. 9A and 9B are a pair of graphs showing the amount of increase in a gap G after a desk spark test.

FIG. 9(A) is a graph showing the relation between the fusion-zone level difference LA and the amount of increase in the gap G after the test. The horizontal axis of FIG. 9(A) shows the fusion-zone level difference LA, whereas the vertical axis shows the amount of increase in the gap G (mm) as measured after the desk spark test was conducted for 100 hours. As is understood from FIG. 9(A), the smaller the fusion-zone level difference LA, the smaller the amount of increase in the gap G, whereby the durability of the ground electrode tip 95 improves. Also, when the fusion-zone level difference LA is reduced to 0.3 or less, the amount of increase in the gap G can be restrained to 0.1 mm, whereby the durability of the ground electrode tip 95 can be further improved. Therefore, preferably, the fusion zone 98 is formed such that the fusion-zone level difference LA is 0.3 mm or less. Similarly, in the spark plug 100*d* shown in FIG. 6, preferably, the fusion zone 98*d* is formed such that the fusion-zone level difference LA is 0.3 mm or less.

G2. Example Experiment 2 on Amount of Increase in Gap G

A desk spark test was conducted on spark plug samples which have the configuration shown in FIG. 3 and differ in the distance X from the back end 94 of the fusion zone 98 with respect to the melting direction to such the portion P of the fusion zone 98 as to have a thickness Ax of A/1.3, in order to study the relation between the distance X and the amount of increase in the gap G after the test. The test conditions are similar to those of the above-mentioned desk spark test regarding the fusion-zone level difference LA.

Figure 9B:
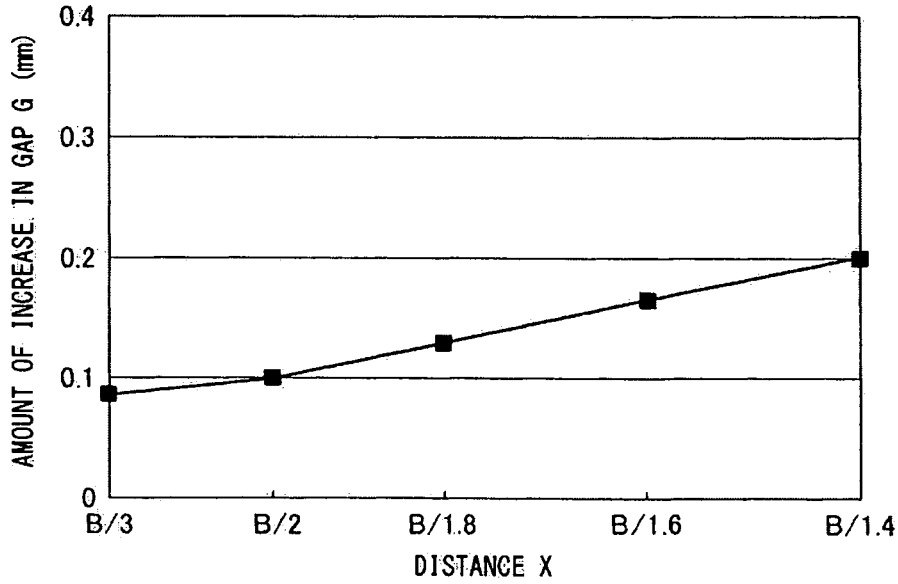

FIG. 9(B) is a graph showing the relation between the distance X and the amount of increase in the gap G after the test. The horizontal axis of FIG. 9(B) shows the distance X, whereas the vertical axis shows the amount of increase in the gap G (mm) as measured after the desk spark test was conducted for 100 hours. As is understood from FIG. 9(B), the smaller the distance X, the smaller the amount of increase in the gap G, whereby the durability of the ground electrode tip 95 improves. Also, when the distance X is smaller than B/2; i.e., when the portion P of the fusion zone 98 which has a thickness Ax of A/1.3 is located within a range of B/2 extending from the other end of the fusion zone 98, the amount of increase in the gap G can be restrained to 0.1 mm, whereby the durability of the ground electrode tip 95 can be further improved. Therefore, preferably, the fusion zone 98 is formed such that the distance X is B/2 or less. Similarly, in the spark plug 100*d* shown in FIG. 6, preferably, the fusion zone 98*d* is formed such that the distance X is E/2 or less.

H. Other Embodiments

The present invention is not limited to the above-described embodiments or modes, but may be embodied in various other forms without departing from the gist of the invention. For example, the following embodiments are also possible.

Figure 10A:
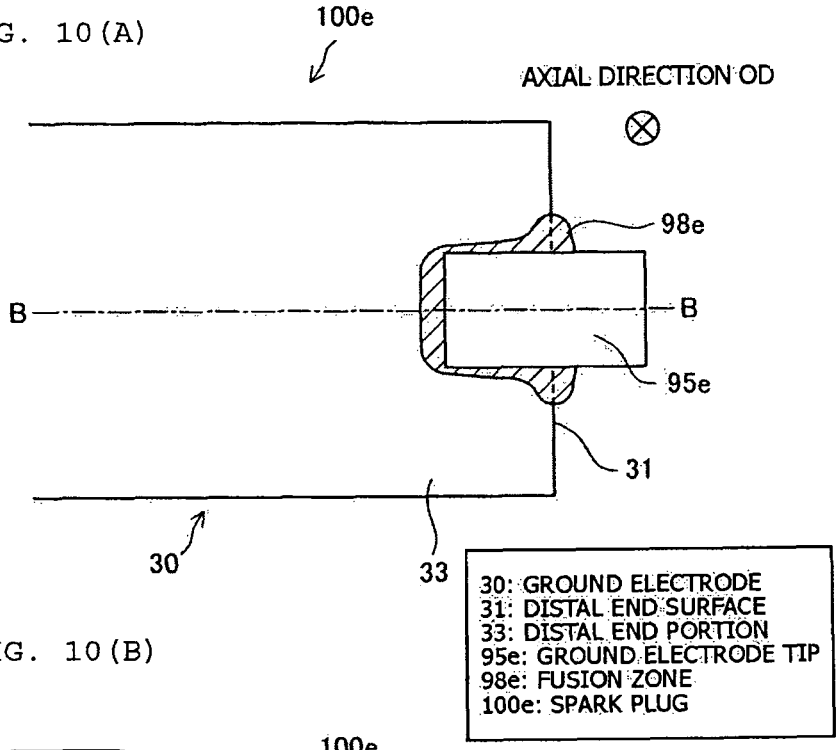
FIG. 10(A) is an explanatory view showing a fusion zone 98*e* in another embodiment of the present invention as viewed from the axial direction.
Figure 10B:
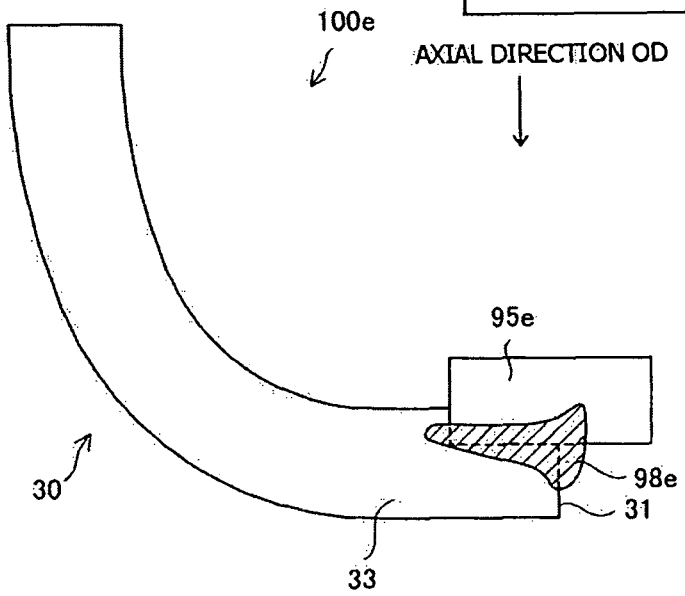
FIG. 10(B) is a sectional view taken along line B-B of FIG. 10(A).

FIGS. 10(A) and 10(B) are a pair of explanatory views showing a fusion zone 98*e* of a spark plug 100*e* according to another embodiment of the present invention. FIG. 10(A) is a view showing the distal end portion 33 of the ground electrode 30 as viewed from the axial direction OD. FIG. 10(B) is a sectional view taken along line B-B of FIG. 10(A). These conventions also apply to FIGS. 11 to 14. As shown in FIGS. 10(A) and 10(B), substantially half of the ground electrode tip 95*e* projects from the distal end surface 31 of the ground electrode 30, and the fusion zone 98*e* may not be formed at the projecting portion.

Figure 11A:
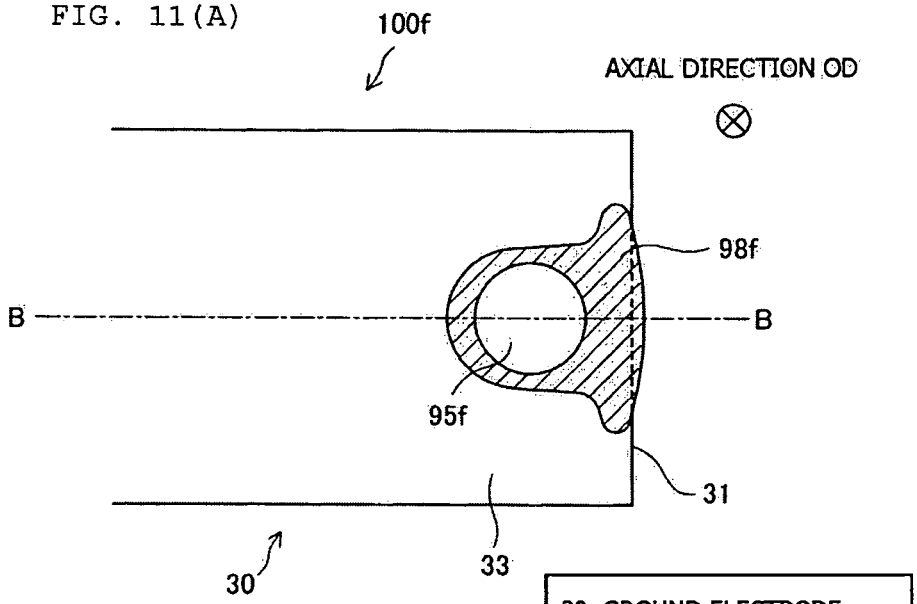
FIG. 11(A) is an explanatory view showing a fusion zone 98*f* in a further embodiment of the present invention as viewed from the axial direction.
Figure 11B:
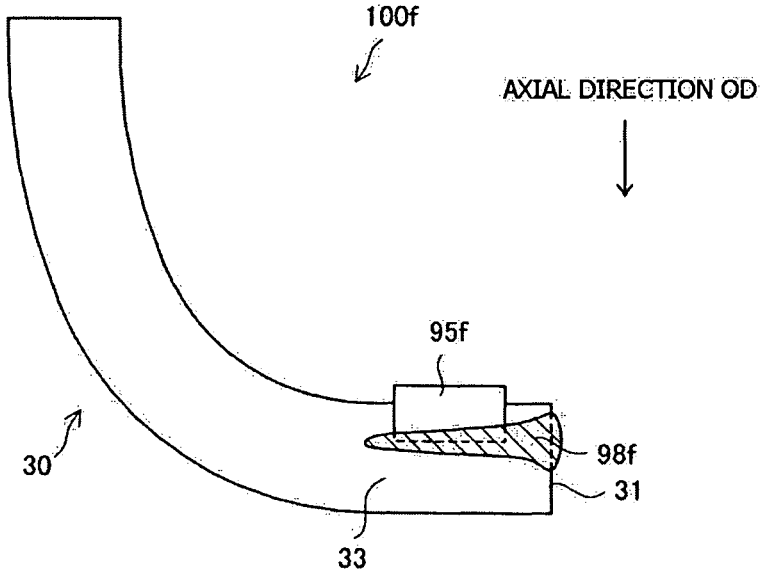
FIG. 11(B) is a sectional view taken along line B-B of FIG. 11(A).

FIGS. 11(A) and 11(B) are a pair of explanatory views showing a fusion zone 98*f* of a spark plug 100*f* according to a further embodiment of the present invention. As shown in FIGS. 11(A) and 11(B), a ground electrode tip 95*f* may have a circular columnar shape. Also, the ground electrode tip 95*f* may not project from the distal end surface 31 of the ground electrode 30.

Figure 12A:
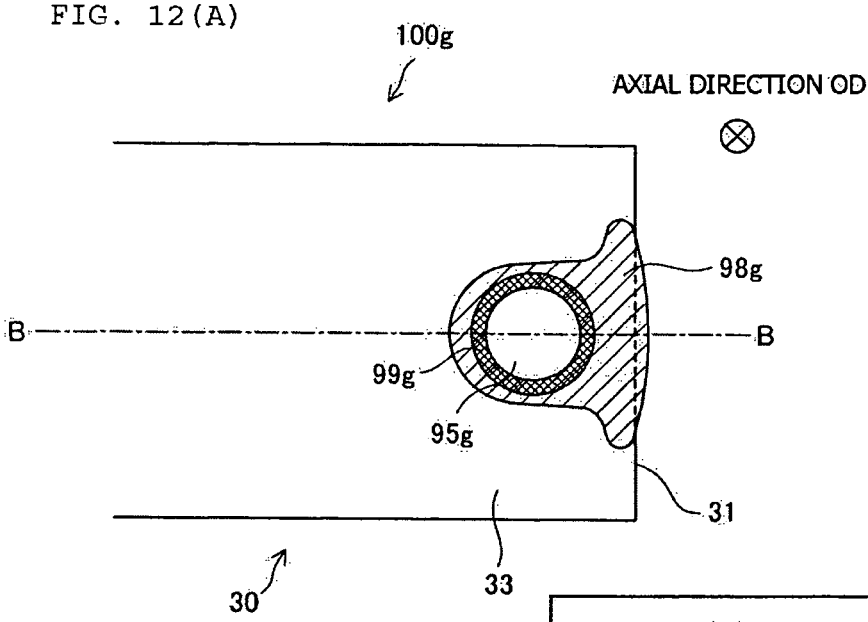
FIG. 12(A) is an explanatory view showing a fusion zone 98*g* in a still further embodiment of the present invention as viewed from the axial direction.
Figure 12B:
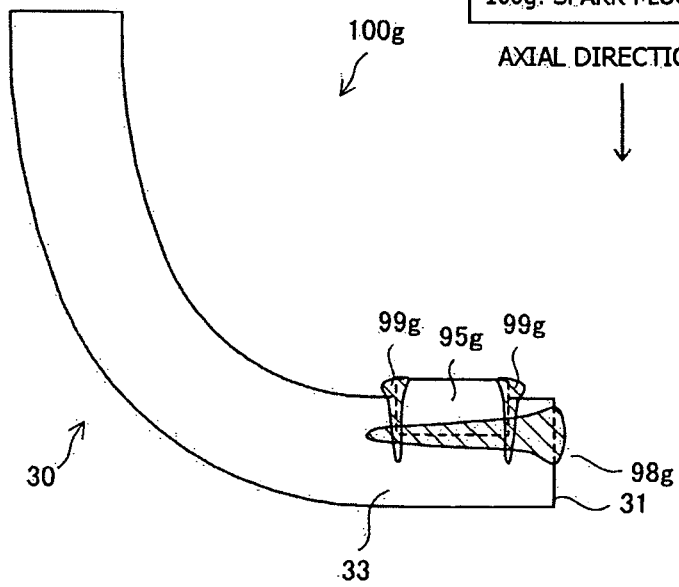
FIG. 12(B) is a sectional view taken along line B-B of FIG. 12(A).

FIGS. 12(A) and 12(B) are a pair of explanatory views showing a fusion zone 98*g* of a spark plug 100*g* according to a still further embodiment of the present invention. As shown in FIGS. 12(A) and 12(B), a ground electrode tip 95*g* may have a circular columnar shape. Also, a fusion zone 99*g* may be formed at a circumferential portion of the ground electrode tip 95*g* through additional radiation of a fiber laser beam or an electron beam from the axial direction OD. By virtue of this, the welding strength of the ground electrode tip 95*g* can be further improved.

Figure 13A:
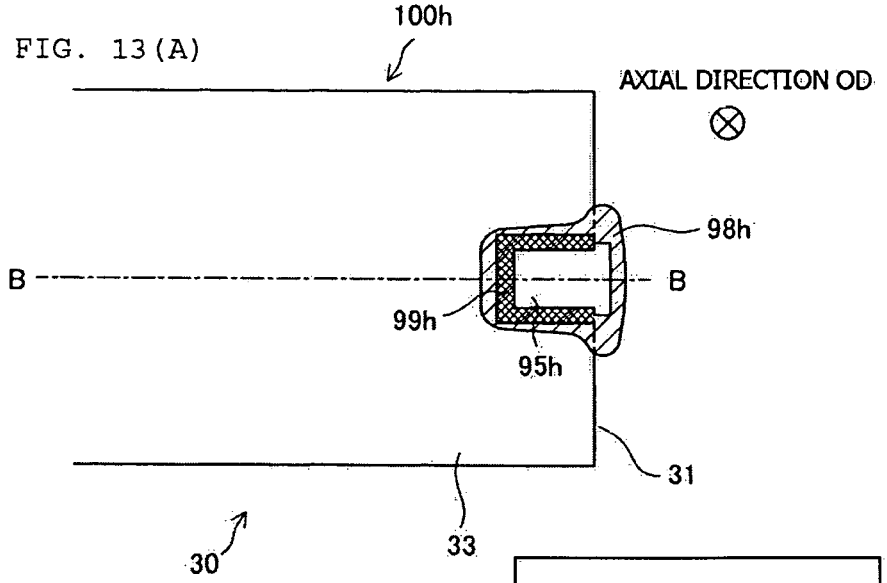
FIG. 13(A) is an explanatory view showing a fusion zone 98*h* in yet another embodiment of the present invention as viewed from the axial direction.
Figure 13B:
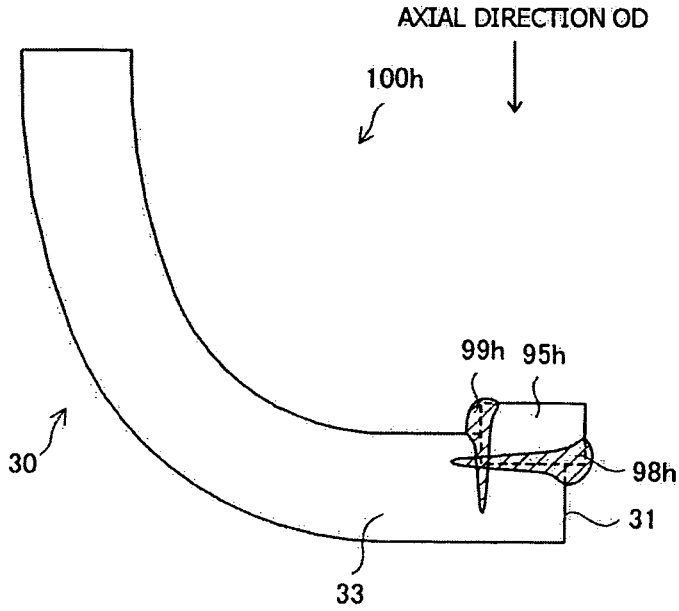
FIG. 13(B) is a sectional view taken along line B-B of FIG. 13(A).

FIGS. 13(A) and 13(B) are a pair of explanatory views showing a fusion zone 98*h* of a spark plug 100*h* according to yet another embodiment of the present invention. As shown in FIGS. 13(A) and 13(B), a fusion zone 99*h* may be formed at a perimetric portion of a ground electrode tip 95*h* through additional radiation of a fiber laser beam or an electron beam from the axial direction OD. By virtue of this, the welding strength of the ground electrode tip 95*h* can be further improved.

Figure 14A:
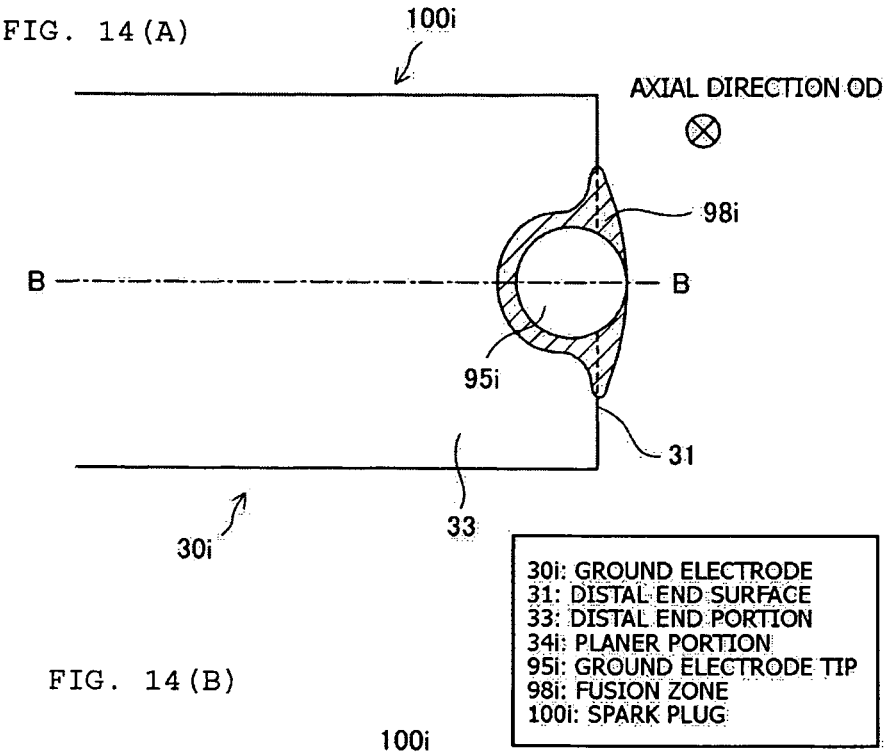
FIG. 14(A) is an explanatory view showing a fusion zone 98*i* in another embodiment of the present invention as viewed from the axial direction.
Figure 14B:
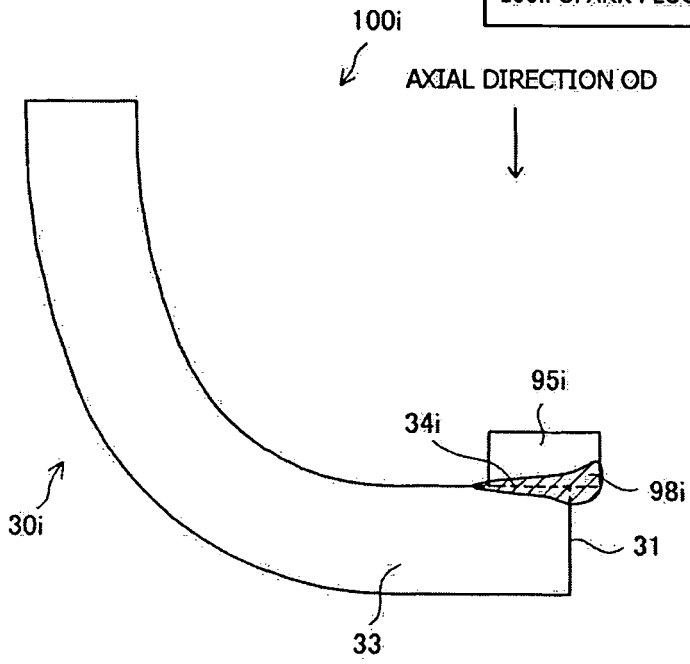
FIG. 14(B) is a sectional view taken along line B-B of FIG. 14(A).

FIGS. 14(A) and 14(B) are a pair of explanatory views showing a fusion zone 98*i* of a spark plug 100*i* according to another embodiment of the present invention. As shown in FIGS. 14(A) and 14(B), a ground electrode tip 95*i* may have a circular columnar shape. Also, a ground electrode 30*i* may not have a groove portion such that the ground electrode tip 95*i* is disposed on a planar portion 34*i* of the ground electrode 30*i*.

Figure 15A:
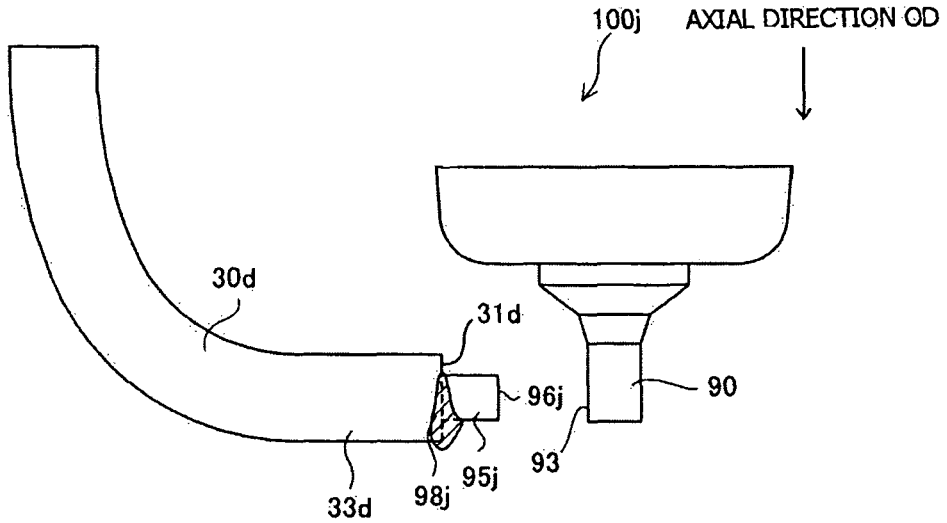
FIGS. 15(A), 15(B) and 15(C) are sets of explanatory views showing the distal end portion 33*d* of the ground electrode 30*d* and its periphery of a spark plug 100*j* according to a further embodiment of the present invention.
Figure 15B:
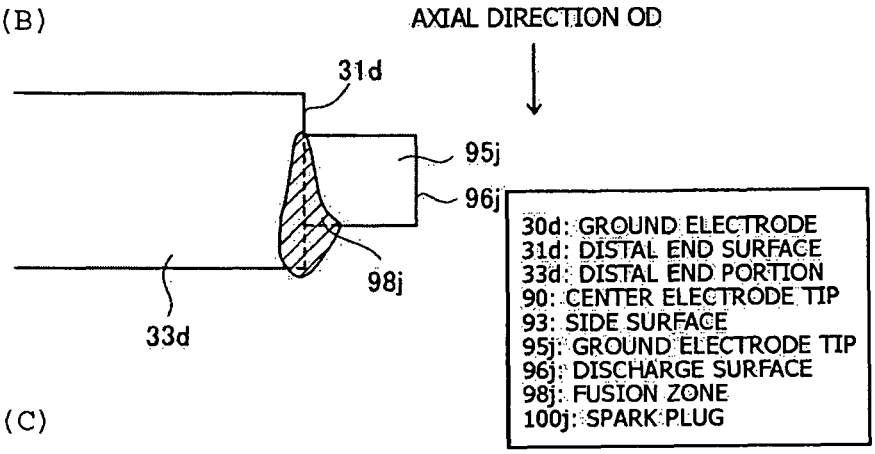
Figure 15C:
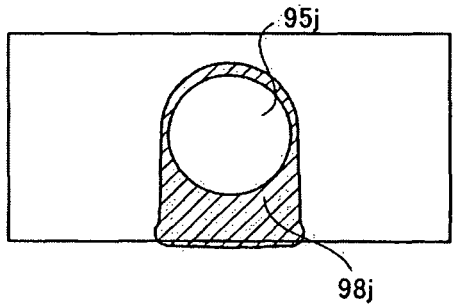

FIG. 15(A) is an explanatory view showing the distal end portion 33*d* of the ground electrode 30*d* and its periphery of a spark plug 100*j* according to a further embodiment of the present invention. FIG. 15(B) is an explanatory view showing, on an enlarged scale, the distal end portion of 33*d* of the ground electrode 30*d*. FIG. 15(C) is a view showing a ground electrode tip 95*j* as viewed from a direction perpendicular to a discharge surface 96*j*. Similar to the spark plug 100*d* according to the fourth embodiment shown in FIG. 6, the spark plug 100*j* is a lateral-discharge-type spark plug. However, in the spark plug 100*j*, the ground electrode tip 95*j* has a circular columnar shape. In this manner, in the lateral-discharge-type spark plug, the ground electrode tip 95*j* may have a circular columnar shape.

Figure 16:
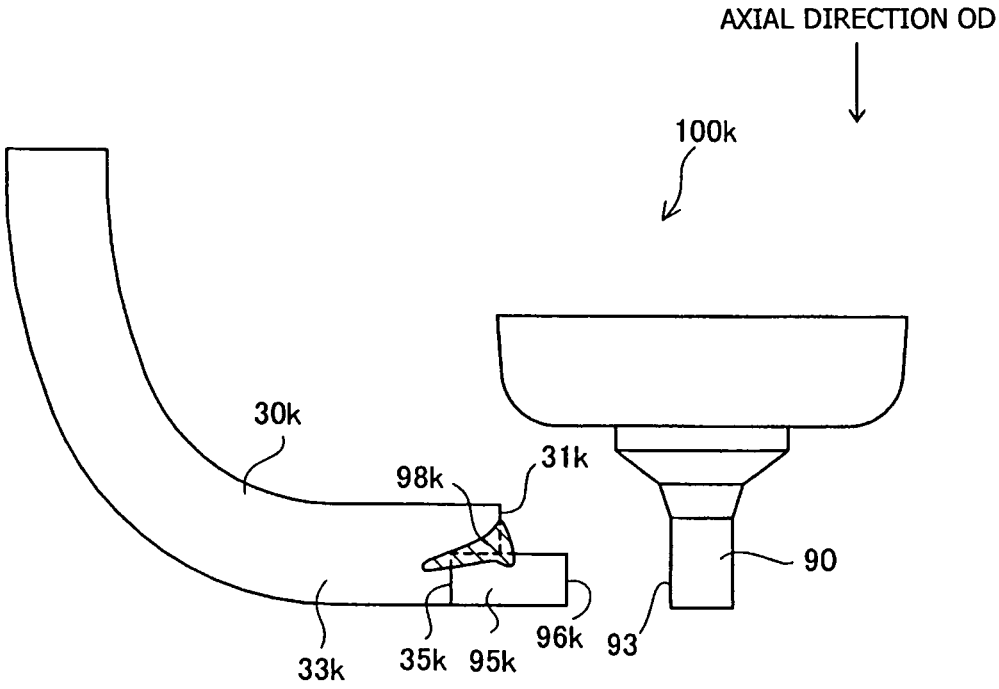
FIG. 16 is an explanatory view showing a fusion zone 98*k* in a still further embodiment of the present invention.

FIG. 16 is an explanatory view showing a fusion zone 98*k* of a spark plug 100*k* according to a still further embodiment of the present invention. Similar to the spark plug 100*d* according to the fourth embodiment shown in FIG. 6, the spark plug 100*k* is a lateral-discharge-type spark plug. However, in the spark plug 100*k*, a groove portion 35*k* is provided at a distal end portion 33*k* of a ground electrode 30*k*. In this manner, in the lateral-discharge-type spark plug, the ground electrode 30*k* may have the groove portion 35*k* formed therein. Also, in this case, preferably, the fusion zone 98*k* is formed through radiation of a high-energy beam such as a fiber beam from a direction oblique to a distal end surface 31*k* of the ground electrode 30*k*.

Figure 17:
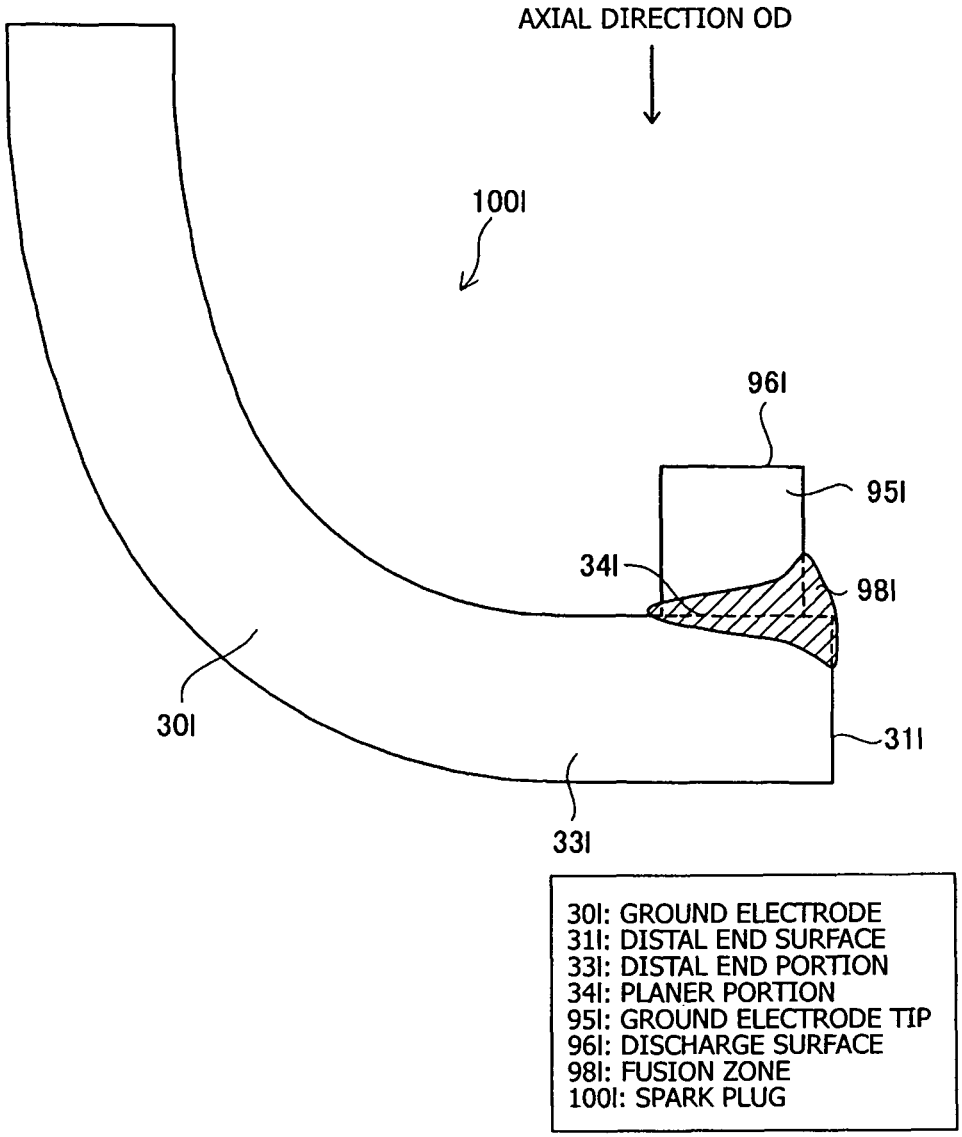
FIG. 17 is an explanatory view showing a fusion zone 981 in a further embodiment of the present invention.

FIG. 17 is an explanatory view showing a fusion zone 981 of a spark plug 1001 according to a further embodiment of the present invention. As shown in FIG. 17, the length of a ground electrode tip 951 along the axial direction OD may be equal to or greater than the length of the ground electrode tip 951 along a direction perpendicular to the axial direction OD. Also, a ground electrode 301 may not have a groove portion such that the ground electrode tip 951 is disposed on a planar portion 341 of the ground electrode 301.

The invention claimed is:

1. A spark plug comprising:

an insulator having an axial hole extending therethrough in an axial direction;

a center electrode provided at a front end portion of the axial hole;

a substantially tubular metallic shell which holds the insulator;

a ground electrode whose one end is attached to a front end portion of the metallic shell and whose other end faces a front end portion of the center electrode; and a noble metal tip provided on a surface of the ground electrode which faces the front end portion of the center electrode, and which forms a spark discharge gap in cooperation with the center electrode;

the spark plug being characterized in that:

a fusion zone is formed along at least a portion of the boundary between the ground electrode and the noble metal tip through fusion of a portion of the ground electrode and a portion of the noble metal tip; and when A represents the thickness of the thickest portion of the fusion zone as measured along the axial direction, and B represents the length of the longest portion of the fusion zone as measured along a longitudinal direction of the ground electrode, a relation $1.5 \leq B/A$ is satisfied.

2. A spark plug according to claim 1, wherein when the fusion zone is cut by a plane which passes through a center axis of the ground electrode and is in parallel with the axial direction, a portion of the fusion zone which has a thickness of A/1.3 is located within a range of B/2 extending from a back end of the fusion zone with respect to a melting direction.

3. A spark plug according to claim 1 or 2, wherein when the noble metal tip has a length of C as measured along the longitudinal direction of the ground electrode, a relation $C \leq B$ is satisfied.

4. A spark plug comprising:

an insulator having an axial hole extending therethrough in an axial direction;

a center electrode provided at a front end portion of the axial hole;

a substantially tubular metallic shell which holds the insulator;

a ground electrode whose one end is attached to a front end portion of the metallic shell and whose other end faces a side surface of the center electrode; and a noble metal tip provided on a surface of the ground electrode which faces the side surface of the center electrode, and forming a spark discharge gap in cooperation with the center electrode;

the spark plug being characterized in that:

a fusion zone is formed along at least a portion of the boundary between the ground electrode and the noble metal tip through fusion of a portion of the ground electrode and a portion of the noble metal tip;

the thickness of the fusion zone as measured along a longitudinal direction of the ground electrode increases frontward with respect to the axial direction; and when D represents the thickness of the thickest portion of the fusion zone as measured along the longitudinal direction of the ground electrode, and E represents the length of the longest portion of the fusion zone as measured along the axial direction, a relation $1.5 \leq E/D$ is satisfied.

5. A spark plug according to claim 4, wherein the weld zone has a width perpendicular to the axial direction and to the longitudinal direction of the ground electrode, and the width of the fusion zone increases frontward with respect to the axial direction.

6. A spark plug according to claim 4 or 5, wherein when the fusion zone is cut by a plane which passes through a center axis of the ground electrode and is in parallel with the axial direction, a portion of the fusion zone which has a thickness of D/1.3 is located within a range of E/2 extending from a back end of the fusion zone with respect to a melting direction.

7. A spark plug according to any one of claim 4 or 5, wherein, when E represents the length of the longest portion of the fusion zone as measured along the axial direction, and F represents the length of the noble metal tip as measured along the axial direction, a relation $F \leq E$ is satisfied.

8. A spark plug according to claims 1, 2 and 4, wherein the noble metal tip has a discharge surface which forms the spark discharge gap in cooperation with the center electrode;

at least a portion of the noble metal tip is fitted in a groove portion formed in the ground electrode; and the fusion zone for connecting the groove portion and the noble metal tip is also formed at such a portion of the boundary between the groove portion and the noble metal tip that is perpendicular to the discharge surface of the noble metal tip.

9. A spark plug according to claims 1, 2, and 4, wherein the fusion zone is not formed on a surface of the noble metal tip which faces the center electrode.

10. A spark plug according to claims 1, 2 and 4, wherein, when L1 represents a depth from a discharge surface of the noble metal tip to a portion of the fusion zone located closest to the discharge surface, and L2 represents a depth from the discharge surface of the noble metal tip to a portion of the fusion zone located most distant from the discharge surface, a relation L2−L1 0.3 mm is satisfied.

11. A spark plug according to claims 1, 2 and 4, wherein half or more of the boundary between the noble metal tip and a portion of the fusion zone located on a side opposite a surface of the noble metal tip which faces the center electrode is in parallel with the discharge surface of the noble metal tip.

12. A spark plug according to claims 1, 2 and 4, wherein the fusion zone is formed through radiation of a high-energy beam toward the boundary between the ground electrode and the noble metal tip from a direction parallel to the boundary.

13. A spark plug according to claims 1, 2 and 4, wherein the fusion zone is formed through radiation of a high-energy beam toward the boundary between the ground electrode and the noble metal tip from a direction oblique to the boundary.

14. A spark plug according to claims 1, 2 and 4, wherein the fusion zone is formed through radiation of a fiber laser beam or an electron beam toward the boundary between the ground electrode and the noble metal tip.

15. A spark plug according to claim 3, wherein the noble metal tip has a discharge surface which forms the spark discharge gap in cooperation with the center electrode;

at least a portion of the noble metal tip is fitted in a groove portion formed in the ground electrode; and the fusion zone for connecting the groove portion and the noble metal tip is also formed at such a portion of the boundary between the groove portion and the noble metal tip that is perpendicular to the discharge surface of the noble metal tip.

16. A spark plug according to claim 3, wherein the fusion zone is not formed on a surface of the noble metal tip which faces the center electrode.

17. A spark plug according to claim 3, wherein, when L1 represents a depth from a discharge surface of the noble metal tip to a portion of the fusion zone located closest to the discharge surface, and L2 represents a depth from the discharge surface of the noble metal tip to a portion of the fusion zone located most distant from the discharge surface, a relation L2−L1 0.3 mm is satisfied.

18. A spark plug according to claim 3, wherein half or more of the boundary between the noble metal tip and a portion of the fusion zone located on a side opposite a surface of the noble metal tip which faces the center electrode is in parallel with the discharge surface of the noble metal tip.

19. A spark plug according to claim 3, wherein the fusion zone is formed through radiation of a high-energy beam toward the boundary between the ground electrode and the noble metal tip from a direction parallel to the boundary.

20. A spark plug according to claim 3, wherein the fusion zone is formed through radiation of a high-energy beam toward the boundary between the ground electrode and the noble metal tip from a direction oblique to the boundary.

21. A spark plug according to claim 3, wherein the fusion zone is formed through radiation of a fiber laser beam or an electron beam toward the boundary between the ground electrode and the noble metal tip.

* * * * *